US011168414B2

(12) United States Patent
Agarwal

(10) Patent No.: US 11,168,414 B2
(45) **Date of Patent: *Nov. 9, 2021**

(54) SELECTIVE ABRADING OF A SURFACE OF A WOVEN TEXTILE FABRIC WITH PROLIFERATED THREAD COUNT BASED ON SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE

(71) Applicant: Arun Agarwal, Dallas, TX (US)

(72) Inventor: Arun Agarwal, Dallas, TX (US)

( * ) Notice: Subject to any disclaimer, the term of this patent is extended or adjusted under 35 U.S.C. 154(b) by 106 days.

This patent is subject to a terminal disclaimer.

(21) Appl. No.: 16/592,750

(22) Filed: Oct. 3, 2019

(65) Prior Publication Data

US 2020/0032432 A1 Jan. 30, 2020

Related U.S. Application Data

(63) Continuation of application No. 15/652,230, filed on Jul. 17, 2017, now Pat. No. 10,472,744, which is a (Continued)

(51) Int. Cl.
*D03D 23/00* (2006.01)
*D03D 1/00* (2006.01)

(Continued)

(52) U.S. Cl.
CPC ..... *D03D 1/0017* (2013.01); *A47G 9/0238* (2013.01); *D03D 1/00* (2013.01);

(Continued)

(58) Field of Classification Search
CPC ..... D03D 15/00; D03D 25/00; D03D 1/00; A47G 9/02; A45F 5/00; A45F 2005/008;

(Continued)

(56) References Cited

U.S. PATENT DOCUMENTS 1,334,901 A 3/1920 Higdon
2,505,027 A 7/1946 Belsky (Continued)

FOREIGN PATENT DOCUMENTS

CA 2155880 A1 2/1997
CA 2346947 A1 5/2000

(Continued)

OTHER PUBLICATIONS

"Woven Fabrics and Ultraviolet Protection", University of Maribor, Faculty of Mechanical Engineering, Slovenia on Aug. 18, 2010 by Polona Dobnik Dubrovski (pp. 25) http://cdn.intechopen.com/pdfs-wm/12251.pdf.

(Continued)

*Primary Examiner* — Robert H Muromoto, Jr.
(74) *Attorney, Agent, or Firm* — Legalforce RAPC Worldwide

(57) ABSTRACT

A method includes drawing each multiple partially oriented polyester yarn from a corresponding supply package to form an oriented polyester yarn as a single multi-filament polyester weft yarn, inserting the multi-filament polyester weft yarn during a single pick insertion event of a pick insertion apparatus of a loom apparatus through winding the multi-filament polyester weft yarn on a single-pick yarn package, and conveying at least two of the multi-filament polyester weft yarn across a warp shed of the loom apparatus through a set of warp yarns in the single pick insertion event to form an incremental length of a woven textile fabric having a first surface with a majority of ends of the warp yarns and a second surface with a majority of picks of the multi-filament polyester weft yarn thereon. The method also includes solely abrading the second surface to provide for comfort to a user during contact therewith.

20 Claims, 10 Drawing Sheets

Related U.S. Application Data continuation of application No. 15/059,299, filed on Mar. 2, 2016, now Pat. No. 9,708,737, which is a continuation-in-part of application No. 14/801,859, filed on Jul. 17, 2015, now abandoned, which is a continuation of application No. 14/185,942, filed on Feb. 21, 2014, now Pat. No. 9,131,790, said application No. 15/652,230 is a continuation of application No. 15/279,482, filed on Sep. 29, 2016, now Pat. No. 10,066,324, which is a continuation of application No. 15/096,291, filed on Apr. 12, 2016, now Pat. No. 9,481,950, which is a continuation-in-part of application No. 14/801,859, filed on Jul. 17, 2015, now abandoned, which is a continuation of application No. 14/185,942, filed on Feb. 21, 2014, now Pat. No. 9,131,790.

(60) Provisional application No. 61/866,047, filed on Aug. 15, 2013.

(51) Int. Cl.

| | |
|---|---|
| ***A47G 9/02*** | (2006.01) |
| ***D03D 15/00*** | (2021.01) |
| ***D03D 13/00*** | (2006.01) |
| ***D03D 47/30*** | (2006.01) |
| *D03D 25/00* | (2006.01) |

(52) U.S. Cl.

CPC ..... *D03D 13/004* (2013.01); *D03D 13/008* (2013.01); *D03D 15/00* (2013.01); *D03D 47/30* (2013.01); *D03D 47/3046* (2013.01); *D03D 47/3066* (2013.01); *D10B 2201/02* (2013.01); *D10B 2331/04* (2013.01); *D10B 2501/00* (2013.01); *D10B 2503/06* (2013.01)

(58) Field of Classification Search

CPC ..... A45F 2005/006; A45F 2200/0575; A45F 5/02; A45F 5/004; A45F 5/021; A45F 2003/006; A45F 3/14; A63C 11/222; A45C 13/20; A45C 13/30; A45B 2009/025; A41D 19/0048; A44C 5/0007; A44C 5/0038; A44C 5/0053; A62B 35/0031; B25B 23/00; Y10S 224/904; Y10S 224/914

USPC ..... 139/420 R, 426 R, 420 A, 383 R, 139/426 TW; 5/482, 501, 497

See application file for complete search history.

(56) References Cited

U.S. PATENT DOCUMENTS

| | | | |
|---|---|---|---|
| 2,451,533 | A | 10/1948 | Cannon |
| 2,483,861 | A | 10/1949 | Weiss |
| 2,624,893 | A | 1/1953 | Harris |
| 2,662,234 | A | 12/1953 | Citron |
| 2,782,130 | A | 2/1957 | Ness et al. |
| 2,786,291 | A | 4/1957 | Stertz |
| 2,942,280 | A | 6/1960 | May, Jr. |
| 2,963,715 | A | 12/1960 | Young |
| 2,971,095 | A | 2/1961 | Drummond |
| 3,027,573 | A | 4/1962 | Bell, Jr. |
| 3,081,197 | A | 3/1963 | Adelman |
| 3,144,666 | A | 8/1964 | Clark et al. |
| 3,265,527 | A | 8/1966 | Adelman |
| 3,441,063 | A | 4/1969 | Naimer et al. |
| 3,489,591 | A | 1/1970 | Cardarelli |
| 3,536,920 | A | 10/1970 | Krol et al. |
| 3,632,383 | A | 1/1972 | Dominick et al. |
| 3,694,832 | A | 2/1972 | Jamison |
| 3,721,274 | A | 3/1973 | Sherrill et al. |
| 3,774,250 | A | 11/1973 | Miller |
| 3,789,469 | A | 2/1974 | Kodama |
| 3,828,544 | A | 8/1974 | Alker |
| 4,002,427 | A | 1/1977 | Moller et al. |
| 4,042,986 | A | 8/1977 | Goodman et al. |
| 4,085,903 | A | 4/1978 | Kuhnemann |
| 4,191,221 | A | 3/1980 | Boyer |
| 4,196,355 | A | 4/1980 | Maine |
| 4,279,045 | A | 7/1981 | Vitale |
| 4,338,693 | A | 7/1982 | Vitale |
| 4,352,380 | A | 10/1982 | Owen |
| 4,422,195 | A | 12/1983 | Russo et al. |
| 4,429,094 | A | 1/1984 | Massucco |
| 4,485,838 | A | 12/1984 | Shoji et al. |
| 4,496,619 | A | 1/1985 | Okamoto |
| 4,534,819 | A | 8/1985 | Payet |
| 4,546,493 | A | 10/1985 | Bortnick |
| 4,578,306 | A | 3/1986 | Heiman |
| 4,621,489 | A | 11/1986 | Okada |
| 4,634,625 | A | 1/1987 | Franklin |
| 4,651,370 | A | 3/1987 | Vitale |
| 4,662,013 | A | 5/1987 | Harrison |
| 4,670,326 | A | 6/1987 | Heiman |
| 4,672,702 | A | 6/1987 | Isham |
| 4,682,379 | A | 7/1987 | Dugan |
| 4,703,530 | A | 11/1987 | Gusman |
| 4,724,183 | A | 2/1988 | Heiman |
| 4,727,608 | A | 3/1988 | Joyce |
| 4,734,947 | A | 4/1988 | Vitale |
| 4,742,788 | A | 5/1988 | Dugan |
| 4,777,677 | A | 10/1988 | Dugan |
| 4,802,251 | A | 2/1989 | O'Dell |
| 4,825,489 | A | 5/1989 | Ross |
| 4,839,934 | A | 6/1989 | Rojas |
| 4,853,269 | A | 8/1989 | Fukumori |
| 4,861,651 | A | 8/1989 | Goldenhersh |
| 4,896,406 | A | 1/1990 | Weingarten et al. |
| 4,903,361 | A | 2/1990 | Tang |
| 4,912,790 | A | 4/1990 | MacDonald |
| 4,962,546 | A | 10/1990 | Vitale |
| 4,962,554 | A | 10/1990 | Tesch |
| 4,980,564 | A | 12/1990 | Steelmon et al. |
| 4,980,941 | A | 1/1991 | Johnson, III |
| 4,985,953 | A | 1/1991 | Seago et al. |
| 5,010,610 | A | 4/1991 | Ackley |
| 5,010,723 | A | 4/1991 | Wilen |
| 5,020,177 | A | 6/1991 | Etherington |
| 5,029,353 | A | 7/1991 | Kimball et al. |
| 5,046,207 | A | 9/1991 | Chamberlain |
| 5,056,441 | A | 10/1991 | Seago et al. |
| 5,070,915 | A | 12/1991 | Kalin |
| 5,092,006 | A | 3/1992 | Fogel |
| 5,103,504 | A | 4/1992 | Dordevic |
| 5,161,271 | A | 11/1992 | Gronbach |
| 5,167,114 | A | 12/1992 | Stahlecker |
| 5,191,777 | A | 3/1993 | Schnegg |
| 5,217,796 | A | 6/1993 | Kasai et al. |
| 5,244,718 | A | 9/1993 | Taylor et al. |
| 5,249,322 | A | 10/1993 | Seago |
| 5,275,861 | A | 1/1994 | Vaughn |
| 5,285,542 | A | 2/1994 | West et al. |
| 5,287,574 | A | 2/1994 | Kardell et al. |
| 5,325,555 | A | 7/1994 | Whitley |
| 5,364,683 | A | 11/1994 | Flint et al. |
| 5,400,831 | A | 3/1995 | Gheysen |
| 5,414,913 | A | 5/1995 | Hughes |
| 5,465,760 | A | 11/1995 | Mohamed et al. |
| 5,487,936 | A | 1/1996 | Collier |
| 5,488,746 | A | 2/1996 | Hudson |
| 5,495,874 | A | 3/1996 | Heiman |
| 5,503,917 | A | 4/1996 | Hughes |
| 5,524,841 | A | 6/1996 | Rijk et al. |
| 5,530,979 | A | 7/1996 | Whitley |
| 5,531,985 | A | 7/1996 | Mitchell et al. |
| 5,542,137 | A | 8/1996 | Byfield |
| 5,625,912 | A | 5/1997 | McCain et al. |
| 5,628,062 | A | 5/1997 | Tseng |
| 5,635,252 | A | 6/1997 | Fraser, Jr. et al. |
| 5,642,547 | A | 7/1997 | Hutton et al. |

(56) References Cited

U.S. PATENT DOCUMENTS

| | | | | |
|---|---|---|---|---|
| 5,657,798 | A | 8/1997 | Krummheuer et al. | |
| 5,729,847 | A | 3/1998 | Allardice | |
| 5,765,241 | A | 6/1998 | MacDonald | |
| 5,795,835 | A | 8/1998 | Bruner et al. | |
| 5,809,593 | A | 9/1998 | Edwards | |
| 5,843,542 | A | 12/1998 | Brushafer | |
| 5,869,193 | A | 2/1999 | Langley | |
| 5,884,349 | A | 3/1999 | Gretsinger | |
| 5,906,004 | A | 5/1999 | Lebby et al. | |
| 5,932,494 | A | 8/1999 | Crippa | |
| 5,968,854 | A | 10/1999 | Akopian et al. | |
| 5,985,773 | A | 11/1999 | Lee | |
| 5,996,148 | A | 12/1999 | McCain et al. | |
| 6,025,284 | A | 2/2000 | Marco et al. | |
| 6,034,003 | A | 3/2000 | Lee | |
| 6,037,280 | A | 3/2000 | Edwards et al. | |
| 6,098,219 | A | 8/2000 | Milber | |
| 6,148,871 | A | 11/2000 | Hassell et al. | |
| 6,164,092 | A | 12/2000 | Menaker | |
| 6,243,896 | B1 | 6/2001 | Osuna et al. | |
| 6,281,515 | B1 | 8/2001 | Demeo et al. | |
| 6,338,367 | B1 | 1/2002 | Khokar | |
| 6,353,947 | B1 | 3/2002 | McCain et al. | |
| 6,369,399 | B1 | 4/2002 | Smirnov | |
| 6,440,555 | B1 | 8/2002 | Yuuki et al. | |
| 6,468,655 | B1 | 10/2002 | Kato et al. | |
| 6,499,157 | B1 | 12/2002 | McCain et al. | |
| 6,610,395 | B2 | 8/2003 | Rohrbach et al. | |
| 6,689,461 | B2 | 2/2004 | Koyanagi et al. | |
| 6,823,544 | B2 | 11/2004 | Treece | |
| 6,934,985 | B2 | 8/2005 | Sanders | |
| 7,032,262 | B2 | 4/2006 | Creech | |
| 7,070,847 | B2 | 7/2006 | Efird et al. | |
| 7,111,648 | B2 | 9/2006 | Mitchell et al. | |
| 7,140,053 | B1 | 11/2006 | Mangano | |
| 7,143,790 | B2 | 12/2006 | Liao | |
| 7,181,790 | B2 | 2/2007 | Wirtz | |
| 7,325,263 | B2 | 2/2008 | Stribling | |
| 7,398,570 | B2 | 7/2008 | Seago | |
| 7,445,177 | B2 | 11/2008 | Wittmann et al. | |
| 7,476,889 | B2 | 1/2009 | Demeo et al. | |
| 7,484,538 | B2 | 2/2009 | Barratte | |
| 7,501,364 | B2 | 3/2009 | Bouckaert et al. | |
| 7,628,180 | B1 | 12/2009 | Golz | |
| 7,673,656 | B2 | 3/2010 | Heiman | |
| 7,682,994 | B2 | 3/2010 | Van Emden et al. | |
| 7,726,348 | B2 | 6/2010 | Heiman | |
| 7,762,287 | B2 | 7/2010 | Liao | |
| 7,816,288 | B2 | 10/2010 | Leonard et al. | |
| 7,856,684 | B2 | 12/2010 | Robertson et al. | |
| 8,053,379 | B2 | 11/2011 | Tingle et al. | |
| 8,171,581 | B2 | 5/2012 | Agarwall | |
| 8,186,390 | B2 | 5/2012 | Krishnaswamy et al. | |
| 8,230,537 | B2 | 7/2012 | Stewart et al. | |
| 8,267,126 | B2 | 9/2012 | Rabin et al. | |
| 8,278,227 | B2 | 10/2012 | Shibaoka et al. | |
| 8,334,524 | B2 | 12/2012 | Demeo et al. | |
| 8,566,983 | B2 | 10/2013 | Monaco | |
| 8,624,212 | B2 | 1/2014 | Yang et al. | |
| 8,627,521 | B2 | 1/2014 | Rowson et al. | |
| 8,640,282 | B2 | 2/2014 | Maguire et al. | |
| 8,689,375 | B2 | 4/2014 | Stinchcomb | |
| 8,690,964 | B2 | 4/2014 | Kramer et al. | |
| 8,707,482 | B1 | 4/2014 | Ramthun | |
| 8,910,896 | B2 | 12/2014 | Koskol | |
| 8,911,833 | B2 | 12/2014 | Medoff | |
| 8,911,856 | B2 | 12/2014 | Norris | |
| 9,131,790 | B2 * | 9/2015 | Agarwal | A47G 9/0238 |
| 9,259,107 | B2 | 2/2016 | Lilienthal | |
| 9,481,950 | B2 * | 11/2016 | Agarwal | D03D 47/3066 |
| 9,493,892 | B1 * | 11/2016 | Agarwal | D03D 13/008 |
| 9,637,845 | B2 | 5/2017 | Morales | |
| 9,708,737 | B2 * | 7/2017 | Agarwal | D03D 13/004 |
| 10,066,324 | B2 * | 9/2018 | Agarwal | D03D 47/3046 |
| 10,443,159 | B2 * | 10/2019 | Agarwal | D03D 47/30 |
| 10,472,744 | B2 * | 11/2019 | Agarwal | D03D 13/008 |
| 10,808,337 | B2 * | 10/2020 | Agarwal | D02G 1/0213 |
| 2002/0088054 | A1 | 7/2002 | McCain et al. | |
| 2002/0157172 | A1 | 10/2002 | Matsushima et al. | |
| 2002/0174945 | A1 | 11/2002 | Fair | |
| 2003/0092339 | A1 | 5/2003 | Covelli | |
| 2003/0190853 | A1 | 10/2003 | Lovingood | |
| 2003/0194938 | A1 | 10/2003 | Efird et al. | |
| 2004/0031098 | A1 | 2/2004 | Hollander | |
| 2004/0040090 | A1 | 3/2004 | Wootten | |
| 2004/0055660 | A1 | 3/2004 | Heiman | |
| 2004/0067706 | A1 | 4/2004 | Woods | |
| 2005/0039937 | A1 | 2/2005 | Yeh et al. | |
| 2005/0042960 | A1 | 2/2005 | Yeh et al. | |
| 2005/0070192 | A1 | 3/2005 | Lorenzotti et al. | |
| 2005/0095939 | A1 | 5/2005 | Heiman | |
| 2005/0109418 | A1 | 5/2005 | Liao | |
| 2006/0014016 | A1 | 1/2006 | Lardizabal et al. | |
| 2006/0180229 | A1 | 8/2006 | Heiman | |
| 2007/0014967 | A1 | 1/2007 | Tingle et al. | |
| 2007/0113591 | A1 * | 5/2007 | Starbuck | D04B 35/04 66/116 |
| 2007/0202763 | A1 | 8/2007 | Shibaoka et al. | |
| 2008/0057813 | A1 | 3/2008 | Tingle et al. | |
| 2008/0096001 | A1 | 4/2008 | Emden et al. | |
| 2008/0124533 | A1 | 5/2008 | Bouckaert et al. | |
| 2009/0155601 | A1 | 6/2009 | Lavature et al. | |
| 2009/0260707 | A1 | 10/2009 | Aneja et al. | |
| 2010/0015874 | A1 | 1/2010 | Tingle et al. | |
| 2010/0107339 | A1 | 5/2010 | Stinchcomb | |
| 2011/0111666 | A1 | 5/2011 | Kim | |
| 2011/0133011 | A1 | 6/2011 | Lee et al. | |
| 2012/0009405 | A1 | 1/2012 | Krishnaswamy et al. | |
| 2012/0047624 | A1 | 3/2012 | Hubsmith | |
| 2012/0157904 | A1 | 6/2012 | Stein | |
| 2012/0186687 | A1 | 7/2012 | Huffstickler et al. | |
| 2012/0253501 | A1 | 10/2012 | Wirth | |
| 2014/0109315 | A1 | 4/2014 | Lilienthal | |
| 2014/0123362 | A1 | 5/2014 | Seitz et al. | |
| 2014/0157575 | A1 | 6/2014 | Stinchcomb | |
| 2014/0166909 | A1 | 6/2014 | Onizawa | |
| 2014/0304922 | A1 | 10/2014 | Kramer et al. | |
| 2014/0310858 | A1 | 10/2014 | Kupiec | |
| 2014/0342970 | A1 | 11/2014 | Kramer et al. | |
| 2015/0026893 | A1 | 1/2015 | Garrett et al. | |
| 2015/0047736 | A1 | 2/2015 | Agarwal | |

FOREIGN PATENT DOCUMENTS

| | | | |
|---|---|---|---|
| CN | 1361315 | A | 7/2002 |
| CN | 101385091 | A | 3/2009 |
| CN | 202072865 | U | 12/2011 |
| CN | 203475074 | U | 3/2014 |
| CN | 103820902 | A | 5/2014 |
| EP | 0758692 | A1 | 2/1997 |
| EP | 0913518 | A1 | 5/1999 |
| EP | 1389645 | A2 | 2/2004 |
| EP | 1678358 | A1 | 7/2006 |
| EP | 1400616 | B1 | 2/2007 |
| WO | 2002059407 | A1 | 8/2002 |
| WO | 2005045111 | A1 | 5/2005 |
| WO | 2006062495 | A1 | 6/2006 |
| WO | 2006069007 | A2 | 6/2006 |
| WO | 2006114207 | A1 | 11/2006 |
| WO | 2007133177 | A2 | 11/2007 |
| WO | 2008042082 | A2 | 4/2008 |
| WO | 2009115622 | A1 | 9/2009 |
| WO | 2013148659 | A1 | 10/2013 |

OTHER PUBLICATIONS

"Electromagnetic Shielding Fabrics", LessEMF.com website on Jul. 8, 2015 (pp. 19) http://www.lessemf.com/fabric.html.

"Ultraviolet (UV) Protection of Textiles: A Review", International Scientific Conference, Gabrovo on Nov. 19-20, 2010 by Mine Akgun et al. (pp. 11) http://www.singipedia.com/attachment.php?attachmentid=1907&d=1296035072.

(56) References Cited

OTHER PUBLICATIONS

"Textiles in Electromagnetic Radiation Protection", Journal of Safety Engineering, p-ISSN: 2325-0003 in 2013 by Subhankar Maity et al. (pp. 9) http://www.sapub.org/global/showpaperpdf.aspx?doi=10.5923/j.safety.20130202.01.
"UV Protection Textile Materials", AUTEX Research Journal, vol. 7, No. 1 in Mar. 2007 by Saravanan (pp. 10) http://www.autexrj.com/cms/zalaczone_pliki/6-07-1.pdf.
"Fabric structure and design", by N Gokarneshan, 2004 (pp. 152) http://download1121.mediafire.com/87kgl7q913sg/uq77548q3d31hth/Fabric+Structure+Design%28www.amraboikinina.blogspot.com%29.pdf.
A1 Air-jet weaving machine product information, by Dornier, 2011 (pp. 24) https://www.lindauerdornier.com/global/mediathek/brochures/weaving-machine/dornier-air-jet-type-a1-e.pdf.
"Woven Fabrics and Ultraviolet Protection", by Polona Dobnik Dubrovski, Aug. 18, 2010 (pp. 25) https://goo.gl/krjmXe.
"International textile bulletin Yarn and Fabric Forming", 1995 (pp. 11).
"The Modern Textile Dictionary" by George E. Lington, 1954), p. 734, figure/picture 48, Duell, Sloan & Pearce (US) (pp. 3).
"600TC Sheet", by GHCL, Apr. 23, 2010 (pp. 6).
"800TC Sheet", by GHCL, 2012-13, (pp. 3).
"1000TC Sheet", by GHCL, 2012-13, (p. 1).
"T600 CVC Sheet Set", by Bed Bath and Beyond (pp. 4).
"T600 CVC Sheet Set", by Overstock (pp. 4).
"T600 CVC Reversible 4PC Sheet Set", by Costco Wholesale (pp. 2).
"T600 CVC Sheet Set", by Gilt (pp. 4).
"T600 CVC Sheet Set", by JCpenney (pp. 4).
"T600 CVC Sheet Set", by Stage (pp. 3).
"Test report for Alpha CT-650TC", by Alok Industries Ltd., Jul. 16, 2012 (p. 1).
"Merchandise and Advertising Specification Data Sheet", by JCPenney, Mar. 15, 2010 (pp. 5).
"Contains Confidential Business Information Subject to the Protective Order—Inv. No. 337-TA-976" (pp. 1574).
"Finish Fabric Test Reports", by GHCL Limited (Textile division) (pp. 74).
"Product Specification details", by Welspun (pp. 11).

* cited by examiner

SELECTIVE ABRADING OF A SURFACE OF A WOVEN TEXTILE FABRIC WITH PROLIFERATED THREAD COUNT BASED ON SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE

CLAIMS OF PRIORITY

This patent application is a Continuation-in-Part application of, and hereby incorporates the entirety of the disclosures of, and claims priority to, each of the following cases:

1. U.S. patent application Ser. No. 15/652,230 titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE,' filed on Jul. 17, 2017, which further depends on:

(i) U.S. patent application Ser. No. 15/059,299, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE' filed on Mar. 2, 2016, and issued as U.S. Pat. No. 9,708,737 on Jul. 18, 2017, which further depends on:

1. U.S. Continuation patent application Ser. No. 14/801,859, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE' filed on Jul. 17, 2015, which further depends on
2. U.S. Utility patent application Ser. No. 14/185,942 filed on Feb. 21, 2014, and now issued as U.S. Pat. No. 9,131,790, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE,' and granted on Sep. 15, 2015, and which further depends on
3. U.S. Provisional patent application No. 61/866,047, titled 'IMPROVED PROCESS FOR MAKING TEXTURIZED YARN AND FABRIC FROM POLYESTER AND COMPOSITION THEREOF' filed on Aug. 15, 2013, and (ii) U.S. Continuation patent application Ser. No. 15/279,482 titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE,' filed on Sep. 29, 2016 and issued as U.S. Pat. No. 10,066,324 on Sep. 4, 2018, which further depends on:

1. U.S. Continuation patent application Ser. No. 15/096,291, filed on Apr. 12, 2016 and now issued as U.S. Pat. No. 9,481,950 on Nov. 1, 2016, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE,' which further depends on
2. U.S. Continuation patent application Ser. No. 14/801,859, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE' filed on Jul. 17, 2015, which further depends on
3. U.S. Utility patent application Ser. No. 14/185,942 filed on Feb. 21, 2014, and now issued as U.S. Pat. No. 9,131,790 on Sep. 15, 2015, titled 'PROLIFERATED THREAD COUNT OF A WOVEN TEXTILE BY SIMULTANEOUS INSERTION WITHIN A SINGLE PICK INSERTION EVENT OF A LOOM APPARATUS MULTIPLE ADJACENT PARALLEL YARNS DRAWN FROM A MULTI-PICK YARN PACKAGE,' and which further depends on
4. U.S. Provisional patent application No. 61/866,047, titled 'IMPROVED PROCESS FOR MAKING TEXTURIZED YARN AND FABRIC FROM POLYESTER AND COMPOSITION THEREOF' filed on Aug. 15, 2013.

FIELD OF TECHNOLOGY

This disclosure relates generally to textiles and, more particularly, to a method, a device and/or a system of selective abrading of a surface of a woven textile fabric with proliferated thread count based on simultaneous insertion within a single pick insertion event of a loom apparatus multiple adjacent parallel yarns drawn from a multi-pick yarn package.

BACKGROUND

A consumer textile, for example apparel or bed sheets, may possess several characteristics that make it desirable. One desirable characteristic may be comfort for fabrics that come in contact with human skin. Another desirable characteristic may be durability, as consumer textiles may be laundered in machine washers and dryers that may tend to shorten the useful lifespan of the textile. In commercial operations, machine laundering may occur more than in residential or small-scale settings, which may further shorten the lifespan of the textile.

For textiles that contact human skin (for example T-shirts, underwear, bed sheets, towels, pillowcases), one method to increase comfort may be to use cotton yarns. Cotton may have high absorbency and breathability. Cotton may also generally be known to have a good "feel" to consumers.

But cotton may not be robust when placed in an environment with heavy machine laundering. To increase durability while retaining the feel and absorbency of cotton, the cotton yarns may be woven in combination with synthetic fibers such as polyester. Cotton may be used as warp yarns, while synthetic yarns may be used as weft yarns.

Constructing the textile using yarns with a smaller denier may also increase comfort. Using these relatively fine yarns may yield a higher "thread count." A thread count of a textile may be calculated by counting the total weft yarns and warp yarns in along two adjacent edges of a square of fabric that is one-inch by one-inch. The thread count may be a commonly recognized indication of the quality of the textile, and the thread count may also be a measure that consumers associate with tactile satisfaction and opulence.

However, fine synthetic weft yarns, such as polyester, may break when fed into a loom apparatus. Cotton-polyester hybrid weaves may therefore be limited to larger denier synthetic yarns that the loom may effectively use. Thus, the thread count, and its associated comfort and luxury, may be limited.

In an attempt to claim high thread counts, some textile manufacturers may twist two yarns together, such that they may be substantially associated, before using them as a single yarn in a weaving process. A twisted yarn may yield properties in the textile similar to the use of a large denier yarn. Manufactures of textiles with twisted yarns may include within the advertised "thread count" each strand within each twisted yarn, even though the textile may not feel of satisfactory quality once it has been removed from its packaging and handled by the consumer. The Federal Trade Commission has taken the position in an opinion letter that it considers the practice of including each yarn within a twisted yarn in the thread count as deceptive to consumers.

Because fine denier yarns may break in a loom apparatus, cotton-synthetic blends may be limited to low thread counts and thus relatively low quality and comfort.

SUMMARY

Disclosed are a method, a device and/or a system of selective abrading of a surface of a woven textile fabric with proliferated thread count based on simultaneous insertion within a single pick insertion event of a loom apparatus multiple adjacent parallel yarns drawn from a multi-pick yarn package.

In one aspect, a method of a woven textile fabric includes drawing each of multiple partially oriented polyester yarns from a corresponding supply package to form an oriented polyester yarn therefrom as a single multi-filament polyester weft yarn, and inserting the multi-filament polyester weft yarn during a single pick insertion event of a pick insertion apparatus of a loom apparatus through winding the multi-filament polyester weft yarn on a single-pick yarn package. The pick insertion apparatus is an air jet pick insertion apparatus and/or a rapier pick insertion apparatus. The method also includes conveying, through the pick insertion apparatus, at least two of the multi-filament polyester weft yarn across a warp shed of the loom apparatus through a set of warp yarns in the single pick insertion event of the pick insertion apparatus to form an incremental length of the woven textile fabric having a first surface with a majority of ends of the warp yarns thereon and a second surface with a majority of picks of the multi-filament polyester weft yarn thereon.

The second surface is configured to contact a user of the woven textile fabric. Further, the method includes solely abrading the second surface of the woven textile fabric to provide for comfort to the user during the contact therewith.

In another aspect, a system includes a textile fabric weaving apparatus including a multi-pick yarn package, and a loom apparatus including a pick insertion apparatus and a warp shed. The loom apparatus is configured to receive a multi-filament polyester weft yarn inserted during a single pick insertion event of the pick insertion apparatus through the pick insertion apparatus winding the multi-filament polyester weft yarn on a single-pick yarn package. Each of multiple partially oriented polyester yarns is drawn from a corresponding supply package to form an oriented polyester yarn therefrom as the multi-filament polyester weft yarn. The pick insertion apparatus is an air jet pick insertion apparatus and/or a rapier pick insertion apparatus.

The pick insertion apparatus is configured to convey at least two of the multi-filament polyester weft yarn across the warp shed through a set of warp yarns in the single pick insertion event of the pick insertion apparatus to form an incremental length of the woven textile fabric having a first surface with a majority of ends of the warp yarns thereon and a second surface with a majority of picks of the multi-filament polyester weft yarn thereon. The second surface is configured to contact a user of the woven textile fabric. The system also includes an abrading mechanism configured to solely abrade the second surface of the woven textile fabric to provide for comfort to the user during the contact therewith.

In yet another aspect, a method of a woven textile fabric includes drawing each of multiple partially oriented polyester yarns from a corresponding supply package to form an oriented polyester yarn therefrom as a single multi-filament polyester weft yarn, and inserting the multi-filament polyester weft yarn during a single pick insertion event of a pick insertion apparatus of a loom apparatus through winding the multi-filament polyester weft yarn on a single-pick yarn package. The pick insertion apparatus is an air jet pick insertion apparatus and/or a rapier pick insertion apparatus. The method also includes conveying, through the pick insertion apparatus, at least two of the multi-filament polyester weft yarn across a warp shed of the loom apparatus through a set of cotton warp yarns in the single pick insertion event of the pick insertion apparatus to form an incremental length of the woven textile fabric having a first surface with a majority of ends of the cotton warp yarns thereon and a second surface with a majority of picks of the multi-filament polyester weft yarn thereon.

The second surface is configured to contact a user of the woven textile fabric. Further, the method includes solely abrading the second surface of the woven textile fabric to provide for comfort to the user during the contact therewith.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1:
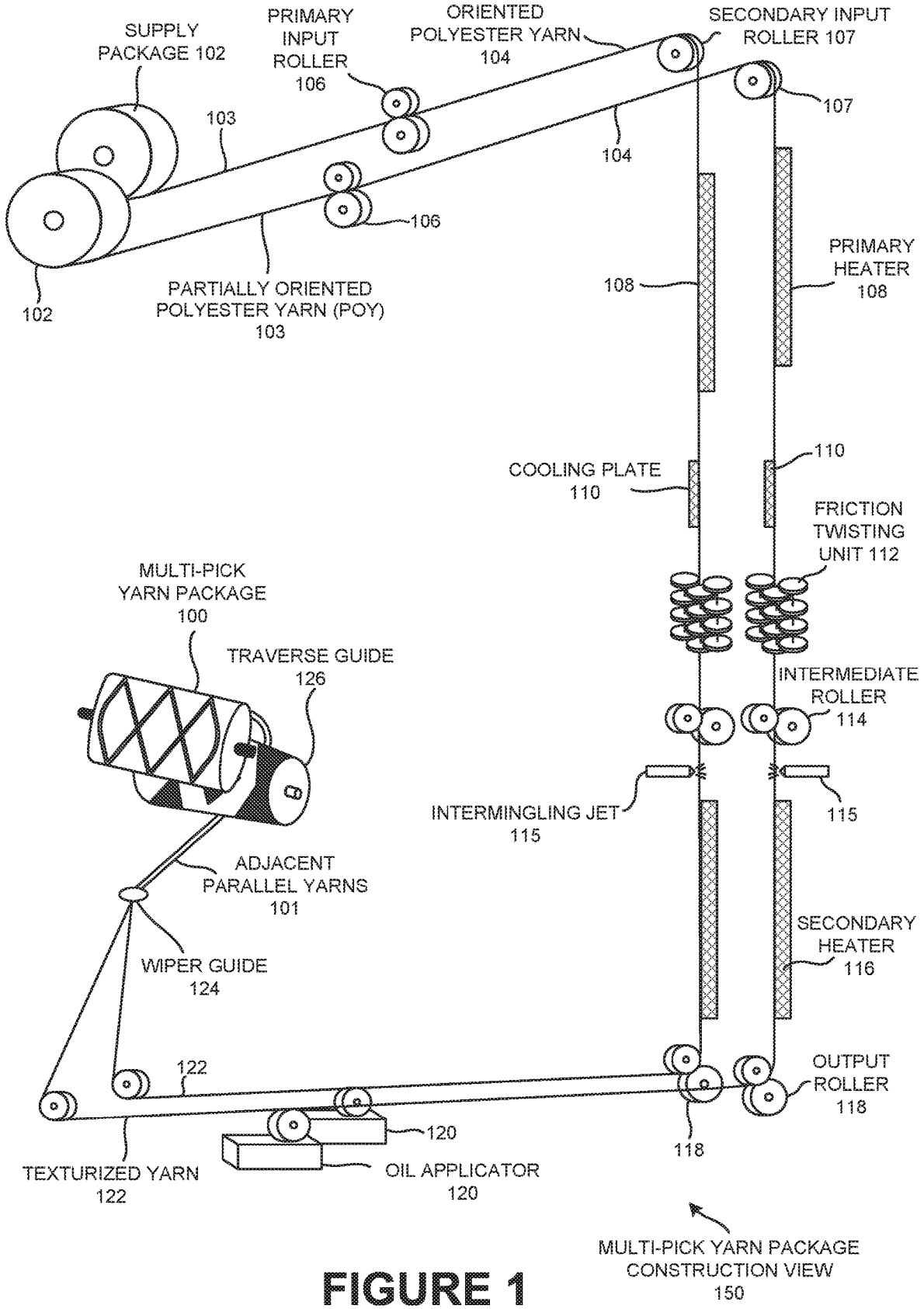
FIG. 1 is a multi-pick yarn package construction view in which two discrete partially-oriented polyester yarns are oriented, texturized, convened to parallel adjacency by a wiper guide, and then wound onto a single multi-pick yarn package, according to one or more embodiments.

Other features of the present embodiments will be apparent from the accompanying drawings and from the detailed description that follows.

DETAILED DESCRIPTION

Disclosed are a method, a device and a system of selective abrading of a surface of a woven textile fabric with proliferated thread count based on simultaneous insertion within a single pick insertion event of a loom apparatus multiple adjacent parallel yarns drawn from a multi-pick yarn package. Although the present embodiments have been described with reference to specific example embodiments, it will be evident that various modifications and changes may be made to these embodiments without departing from the broader spirit and scope of the various embodiments.

In one embodiment, a woven textile fabric includes from 90 to 235 ends per inch warp yarns and from 100 to 965 picks per inch multi-filament polyester weft yarns. The picks are woven into the textile fabric (e.g., textile 420) in groups of at least two multi-filament polyester weft yarns (e.g., adjacent parallel yarns 101, parallel binary yarns 401) running in a parallel form to one another. The multi-filament polyester weft yarns (e.g., adjacent parallel yarns 101, parallel binary yarns 401) are wound in a substantially parallel form to one another, according to one embodiment.

In addition, the multi-filament polyester weft yarns are wound substantially adjacent to one another on a multi-pick yarn package 100 to enable the simultaneous inserting of the multi-filament polyester weft yarns (e.g., adjacent parallel yarns 101, parallel binary yarns 401) during a single pick insertion event 416 of a pick insertion apparatus 404 of a loom apparatus 405, according to one embodiment.

Further, the number of the multi-filament polyester weft yarns (e.g., adjacent parallel yarns 101, parallel binary yarns 401) wound on the weft yarn package (e.g., multi-pick yarn package 100, binary pick-yarn package 400) using the single pick insertion and in a substantially parallel form to one another and substantially adjacent to one another is at least two. The number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between two and eight, according to one embodiment.

The pick insertion apparatus 404 of the loom apparatus 405 is an air jet pick insertion apparatus and/or a rapier pick insertion apparatus. The multi-filament polyester weft yarns (e.g., adjacent parallel yarns 101, parallel binary yarns 401) are wound on the multi-pick yarn package 100 at an angle of between 5 and 25 degrees to enable the simultaneous inserting of the multi-filament polyester weft yarns (e.g., adjacent parallel yarns 101, parallel binary yarns 401, single yarn 701) during the single pick insertion event 416 of the pick insertion apparatus 404 of the loom apparatus 405, according to one embodiment.

In addition, the woven textile fabric (e.g., textile 420) may be made of multi-filament polyester yarns having a denier of 20 to 65. The woven textile fabric may have multi-filament polyester yarns (e.g., adjacent parallel yarns 101, parallel binary yarns 401) having a denier of 15 to 35. The warp yarns 426 may be made of a cotton material. The woven textile fabric (e.g., textile 420) may also have multi-filament polyester yarns (e.g., adjacent parallel yarns 101, parallel binary yarns 401) having a denier of 20 to 25, according to one embodiment.

Additionally, the multi-filament polyester yarns (e.g., adjacent parallel yarns 101, parallel binary yarns 401, single yarn 701) may contain 10 to 30 filaments each. The woven textile fabric (e.g., textile 420) may have a total thread count from 190 to 1200. The woven textile fabric (e.g., textile 420) may have a minimum tensile strength in a warp direction of 17 kilograms to 65 kilograms and a minimum tensile strength in a weft direction of 11.5 kilograms to 100 kilograms. The woven textile fabric (e.g., textile 420) may have a warp-to-fill ratio that is between 1:2 to 1:4, according to one embodiment.

The weft yarns (e.g., adjacent parallel yarns 101, parallel binary yarns 401) within each group run may parallel to each other in a plane which substantially includes the warp yarns 426. Each of the groups may be made up of at least four multi-filament polyester weft yarns (e.g., adjacent parallel yarns 101, parallel binary yarns 401), according to one embodiment.

In another embodiment, a woven textile fabric (e.g., textile 420) includes from 90 to 235 ends per inch warp yarns 426 and from 100 to 965 picks per inch multi-filament polyester weft yarns (e.g., adjacent parallel yarns 101, parallel binary yarns 401). The warp yarns 426 are made of a cotton material and the picks are woven into the textile fabric (e.g., textile 420) in groups of at least two multi-filament polyester weft yarns (e.g., adjacent parallel yarns 101, parallel binary yarns 401) running in a parallel form to one another. The weft yarns (e.g., adjacent parallel yarns 101, parallel binary yarns 401) within each group run parallel to each other in a plane which substantially includes the warp yarns 426. In addition, the multi-filament polyester weft yarns (e.g., adjacent parallel yarns 101, parallel binary yarns 401) are wound in a substantially parallel form to one another and substantially adjacent to one another on a multi-pick yarn package 100 to enable the simultaneous inserting of the multi-filament polyester weft yarns (e.g., adjacent parallel yarns 101, parallel binary yarns 401) during a single pick insertion event 416 of a pick insertion apparatus 404 of a loom apparatus 405.

Further, the number of the multi-filament polyester weft yarns (e.g., adjacent parallel yarns 101, parallel binary yarns 401) wound on the weft yarn package (e.g., multi-pick yarn package 100, binary pick-yarn package 400) in a substantially parallel form to one another and substantially adjacent to one another is at least two. The number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between two and eight. Additionally, the multi-filament polyester weft yarns (e.g., adjacent parallel yarns 101, parallel binary yarns 401) are wound on the multi-pick yarn package 100 at a type A shore hardness of between 45 to 85 to enable the simultaneous inserting of the multi-filament polyester weft yarns (e.g., adjacent parallel yarns 101, parallel binary yarns 401) during the single pick insertion event 416 of the pick insertion apparatus 404 of the loom apparatus 405, according to one embodiment.

In another embodiment, a method of a woven textile fabric (e.g., textile 420) includes forming 190 to 1200 threads per inch fine textile fabric (e.g., textile 420). The method forms the woven textile (e.g., textile 420) having from 90 to 235 ends per inch warp yarns 426 and from 100 to 965 picks per inch multi-filament polyester weft yarns (e.g., adjacent parallel yarns 101, parallel binary yarns 401). The picks are woven into the textile fabric (e.g., textile 420) using single multi-filament polyester weft yarn (e.g., adjacent parallel yarns 101, parallel binary yarns 401). Additionally, the multi-filament polyester weft yarn (e.g., adjacent parallel yarns 101, parallel binary yarns 401) is wound on a single-pick yarn package 700 to enable inserting of the multi-filament polyester weft yarn (e.g., adjacent parallel yarns 101, parallel binary yarns 401) during a single pick insertion event 416 of a pick insertion apparatus 404 of a loom apparatus 405.

Further, the number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is at least one. The pick insertion apparatus 404 of the loom apparatus 405 is an air jet pick insertion apparatus and/or a rapier pick insertion apparatus, according to one embodiment.

In another embodiment, a method of weaving a fabric (e.g., textile 420) includes drawing multiple polyester weft yarns (e.g., adjacent parallel yarns 101, parallel binary yarns 401) from a weft source 403 to a pick insertion apparatus 404 of a loom apparatus 405, according to one embodiment.

Additionally, the method also includes conveying by the pick insertion apparatus 404 the multiple polyester weft yarns across a warp shed 412 of the loom apparatus 405 through a set of warp yarns 426 in a single pick insertion event 416 of the pick insertion apparatus 404 of the loom apparatus 405 and beating the multiple polyester weft yarns into a fell of the fabric (e.g., textile 420) with a reed apparatus 414 of the loom apparatus 405 such that the set of warp yarns 426 and/or the multiple polyester weft yarns (e.g., adjacent parallel yarns 101, parallel binary yarns 401) become interlaced into a woven textile fabric (e.g., textile 420), according to one embodiment.

The method forms the woven textile (e.g., textile 420) having from 90 to 235 ends per inch warp yarns 426 and from 100 to 965 picks per inch multi-filament polyester weft yarns (e.g., adjacent parallel yarns 101, parallel binary yarns 401). In addition, the warp yarns 426 are made of a cotton material. The picks are woven into the textile fabric in groups of two multi-filament polyester weft yarns (e.g., adjacent parallel yarns 101, parallel binary yarns 401) running in a parallel form to one another, according to one embodiment.

The weft yarns within each group run parallel to each other in a plane which substantially includes the warp yarns 426. Further, the multi-filament polyester weft yarns (e.g., adjacent parallel yarns 101, parallel binary yarns 401) are wound in a substantially parallel form to one another, according to one embodiment.

Additionally, the multi-filament polyester weft yarns (e.g., adjacent parallel yarns 101, parallel binary yarns 401) are wound substantially adjacent to one another on a multi-pick yarn package 100 to enable the simultaneous inserting of the multi-filament polyester weft yarns during a single pick insertion event 416 of a pick insertion apparatus 404 of a loom apparatus 405. Furthermore, the number of the multi-filament polyester weft yarns wound on the weft yarn package (e.g., binary pick yarn package 400) in a substantially parallel form to one another and substantially adjacent to one another is at least two, according to one embodiment.

In addition, the number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between two and eight. The multi-filament polyester weft yarns (e.g., adjacent parallel yarns 101, parallel binary yarns 401) are wound on the multi-pick yarn package 100 at an angle of between 15 and/or 20 degrees to enable the simultaneous inserting of the multi-filament polyester weft yarns during the single pick insertion event 416 of the pick insertion apparatus 404 of the loom apparatus 405, according to one embodiment.

In yet another embodiment, a method of woven textile fabric includes forming of 1200 threads per inch fine textile fabric (e.g. textile 420). The woven textile fabric is made from 90 to 235 ends per inch warp yarns and from 100 to 965 picks per inch single multi-filament polyester weft yarn (e.g., single yarn 701). The picks are woven into the textile fabric using single multi-filament polyester weft yarn (e.g., single yarn 701). The multi-filament polyester weft yarn is wound on a single-pick yarn package 700 to enable inserting of the multi-filament polyester weft yarn (e.g., single yarn 701) during a single pick insertion event 416 of a pick insertion apparatus 404 of a loom apparatus 405, according to one embodiment.

The number of the multi-filament polyester weft yarn (e.g., single yarn 701) conveyed by the pick insertion apparatus 404 across a warp shed 412 of the loom apparatus 405 through a set of warp yarns 426 in the single pick insertion event 416 of the pick insertion apparatus 404 of the loom apparatus 405 is at least one, according to one embodiment.

In another embodiment, the pick insertion apparatus 404 of the loom apparatus 405 is an air jet pick insertion apparatus. The multi-filament polyester weft yarn is wound on the single-pick yarn package 700 at an angle of between 15 and 20 degrees to enable inserting of the single multi-filament polyester weft yarn 701 during the single pick insertion event 416 of the pick insertion apparatus 404 of the loom apparatus 405, according to one embodiment.

In one embodiment, a woven textile fabric includes from 90 to 235 ends per inch warp yarns and from 100 to 1016 picks per inch multi-filament polyester weft yarns. The picks are woven into the textile fabric (e.g., textile 420) in groups of at least two multi-filament polyester weft yarns (e.g., adjacent parallel yarns 101, parallel binary yarns 401) running in a parallel form to one another. The multi-filament polyester weft yarns (e.g., adjacent parallel yarns 101, parallel binary yarns 401) are wound in a substantially parallel form to one another, according to one embodiment.

In addition, the multi-filament polyester weft yarns are wound substantially adjacent to one another on a multi-pick yarn package 100 to enable the simultaneous inserting of the multi-filament polyester weft yarns (e.g., adjacent parallel yarns 101, parallel binary yarns 401) during a single pick insertion event 416 of a pick insertion apparatus 404 of a loom apparatus 405, according to one embodiment.

Further, the number of the multi-filament polyester weft yarns (e.g., adjacent parallel yarns 101, parallel binary yarns 401) wound on the weft yarn package (e.g., multi-pick yarn package 100, binary pick-yarn package 400) using the single pick insertion and in a substantially parallel form to one another and substantially adjacent to one another is at least two. The number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between one and eight, according to one embodiment.

The pick insertion apparatus 404 of the loom apparatus 405 is an air jet pick insertion apparatus and/or a rapier pick insertion apparatus. The multi-filament polyester weft yarns (e.g., adjacent parallel yarns 101, parallel binary yarns 401) are wound on the multi-pick yarn package 100 at an angle of between 5 and 25 degrees to enable the simultaneous inserting of the multi-filament polyester weft yarns (e.g., adjacent parallel yarns 101, parallel binary yarns 401, single yarn 701) during the single pick insertion event 416 of the pick insertion apparatus 404 of the loom apparatus 405, according to one embodiment.

In addition, the woven textile fabric (e.g., textile 420) may be made of multi-filament polyester yarns having a denier of 20 to 65. The woven textile fabric may have multi-filament polyester yarns (e.g., adjacent parallel yarns 101, parallel binary yarns 401) having a denier of 15 to 35. The warp yarns 426 may be made of a cotton material. The woven textile fabric (e.g., textile 420) may also have multi-filament polyester yarns (e.g., adjacent parallel yarns 101, parallel binary yarns 401) having a denier of 20 to 25, according to one embodiment.

Additionally, the multi-filament polyester yarns (e.g., adjacent parallel yarns 101, parallel binary yarns 401, single yarn 701) may contain 10 to 30 filaments each. The woven textile fabric (e.g., textile 420) may have a total thread count from 190 to 1200. The woven textile fabric (e.g., textile 420) may have a minimum tensile strength in a warp direction of 17 kilograms to 65 kilograms and a minimum tensile strength in a weft direction of 11.5 kilograms to 100 kilograms. The woven textile fabric (e.g., textile 420) may have a warp-to-fill ratio that is between 1:2 to 1:4, according to one embodiment.

The weft yarns (e.g., adjacent parallel yarns 101, parallel binary yarns 401) within each group run may parallel to each other in a plane which substantially includes the warp yarns 426. Each of the groups may be made up of at least four multi-filament polyester weft yarns (e.g., adjacent parallel yarns 101, parallel binary yarns 401), according to one embodiment.

In another embodiment, a woven textile fabric (e.g., textile 420) includes from 90 to 235 ends per inch warp yarns 426 and from 100 to 1016 picks per inch multi-filament polyester weft yarns (e.g., adjacent parallel yarns 101, parallel binary yarns 401). The warp yarns 426 are made of a cotton material and the picks are woven into the textile fabric (e.g., textile 420) in groups of at least two multi-filament polyester weft yarns (e.g., adjacent parallel yarns 101, parallel binary yarns 401) running in a parallel form to one another. The weft yarns (e.g., adjacent parallel yarns 101, parallel binary yarns 401) within each group run parallel to each other in a plane which substantially includes the warp yarns 426. In addition, the multi-filament polyester weft yarns (e.g., adjacent parallel yarns 101, parallel binary yarns 401) are wound in a substantially parallel form to one another and substantially adjacent to one another on a multi-pick yarn package 100 to enable the simultaneous inserting of the multi-filament polyester weft yarns (e.g., adjacent parallel yarns 101, parallel binary yarns 401) during a single pick insertion event 416 of a pick insertion apparatus 404 of a loom apparatus 405.

Further, the number of the multi-filament polyester weft yarns (e.g., adjacent parallel yarns 101, parallel binary yarns 401) wound on the weft yarn package (e.g., multi-pick yarn package 100, binary pick-yarn package 400) in a substantially parallel form to one another and substantially adjacent to one another is at least two. The number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between one and eight. Additionally, the multi-filament polyester weft yarns (e.g., adjacent parallel yarns 101, parallel binary yarns 401) are wound on the multi-pick yarn package 100 at a type A shore hardness of between 45 to 85 to enable the simultaneous inserting of the multi-filament polyester weft yarns (e.g., adjacent parallel yarns 101, parallel binary yarns 401) during the single pick insertion event 416 of the pick insertion apparatus 404 of the loom apparatus 405, according to one embodiment.

In another embodiment, a method of a woven textile fabric (e.g., textile 420) includes forming 190 to 1200 threads per inch fine textile fabric (e.g., textile 420). The method forms the woven textile (e.g., textile 420) having from 90 to 235 ends per inch warp yarns 426 and from 100 to 1016 picks per inch multi-filament polyester weft yarns (e.g., adjacent parallel yarns 101, parallel binary yarns 401). The picks are woven into the textile fabric (e.g., textile 420) using single multi-filament polyester weft yarn (e.g., adjacent parallel yarns 101, parallel binary yarns 401). Additionally, the multi-filament polyester weft yarn (e.g., adjacent parallel yarns 101, parallel binary yarns 401) is wound on a single-pick yarn package 700 to enable inserting of the multi-filament polyester weft yarn (e.g., adjacent parallel yarns 101, parallel binary yarns 401) during a single pick insertion event 416 of a pick insertion apparatus 404 of a loom apparatus 405.

Further, the number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is at least one. The pick insertion apparatus 404 of the loom apparatus 405 is an air jet pick insertion apparatus and/or a rapier pick insertion apparatus, according to one embodiment.

In another embodiment, a method of weaving a fabric (e.g., textile 420) includes drawing multiple polyester weft yarns (e.g., adjacent parallel yarns 101, parallel binary yarns 401) from a weft source 403 to a pick insertion apparatus 404 of a loom apparatus 405, according to one embodiment.

Additionally, the method also includes conveying by the pick insertion apparatus 404 the multiple polyester weft yarns across a warp shed 412 of the loom apparatus 405 through a set of warp yarns 426 in a single pick insertion event 416 of the pick insertion apparatus 404 of the loom apparatus 405 and beating the multiple polyester weft yarns into a fell of the fabric (e.g., textile 420) with a reed apparatus 414 of the loom apparatus 405 such that the set of warp yarns 426 and/or the multiple polyester weft yarns (e.g., adjacent parallel yarns 101, parallel binary yarns 401) become interlaced into a woven textile fabric (e.g., textile 420), according to one embodiment.

The method forms the woven textile (e.g., textile 420) having from 90 to 235 ends per inch warp yarns 426 and from 100 to 1016 picks per inch multi-filament polyester weft yarns (e.g., adjacent parallel yarns 101, parallel binary yarns 401). In addition, the warp yarns 426 are made of a cotton material. The picks are woven into the textile fabric in groups of two multi-filament polyester weft yarns (e.g., adjacent parallel yarns 101, parallel binary yarns 401) running in a parallel form to one another, according to one embodiment.

The weft yarns within each group run parallel to each other in a plane which substantially includes the warp yarns 426. Further, the multi-filament polyester weft yarns (e.g., adjacent parallel yarns 101, parallel binary yarns 401) are wound in a substantially parallel form to one another, according to one embodiment.

Additionally, the multi-filament polyester weft yarns (e.g., adjacent parallel yarns 101, parallel binary yarns 401) are wound substantially adjacent to one another on a multi-pick yarn package 100 to enable the simultaneous inserting of the multi-filament polyester weft yarns during a single pick insertion event 416 of a pick insertion apparatus 404 of a loom apparatus 405. Furthermore, the number of the multi-filament polyester weft yarns wound on the weft yarn package (e.g., binary pick yarn package 400) in a substantially parallel form to one another and substantially adjacent to one another is at least two, according to one embodiment.

In addition, the number of the multi-filament polyester weft yarns (e.g., adjacent parallel yarns 101, parallel binary yarns 401) conveyed by the pick insertion apparatus 404 across a warp shed 412 of the loom apparatus 405 through a set of warp yarns 426 in the single pick insertion event 416 of the pick insertion apparatus 404 of the loom apparatus 405 is between one and eight. The multi-filament polyester weft yarns (e.g., adjacent parallel yarns 101, parallel binary yarns 401) are wound on the multi-pick yarn package 100 at an angle of between 15 and/or 20 degrees to enable the simultaneous inserting of the multi-filament polyester weft yarns during the single pick insertion event 416 of the pick insertion apparatus 404 of the loom apparatus 405, according to one embodiment.

In yet another embodiment, a method of woven textile fabric includes forming of 1200 threads per inch fine textile fabric (e.g. textile 420). The woven textile fabric is made from 90 to 235 ends per inch warp yarns and from 100 to 1016 picks per inch single multi-filament polyester weft yarn (e.g., single yarn 701). The picks are woven into the textile fabric using single multi-filament polyester weft yarn (e.g., single yarn 701). The multi-filament polyester weft yarn is wound on a single-pick yarn package 700 to enable inserting of the multi-filament polyester weft yarn (e.g., single yarn 701) during a single pick insertion event 416 of a pick insertion apparatus 404 of a loom apparatus 405, according to one embodiment.

The number of the multi-filament polyester weft yarn (e.g., single yarn 701) conveyed by the pick insertion apparatus 404 across a warp shed 412 of the loom apparatus 405 through a set of warp yarns 426 in the single pick insertion event 416 of the pick insertion apparatus 404 of the loom apparatus 405 is at least one, according to one embodiment.

In another embodiment, the pick insertion apparatus 404 of the loom apparatus 405 is an air jet pick insertion apparatus. The multi-filament polyester weft yarn is wound on the single-pick yarn package 700 at an angle of between 15 and 20 degrees to enable inserting of the single multi-filament polyester weft yarn 701 during the single pick insertion event 416 of the pick insertion apparatus 404 of the loom apparatus 405, according to one embodiment.

FIG. 1 is a multi-pick yarn package construction view in which two discrete partially-oriented polyester yarns are oriented, texturized, convened to parallel adjacency by a wiper guide, and then wound onto a single multi-pick yarn package, according to one or more embodiments. Particularly, FIG. 1 illustrates a multi-pick yarn package 100, an adjacent parallel yarns 101, a supply package 102, a partially oriented polyester yarn (POY) 103, an oriented polyester yarn 104, an primary input roller 106, a secondary input roller 107, a primary heater 108, a cooling plate 110, a friction twisting unit 112, an intermediate roller 114, an intermingling jet 115, a secondary heater 116, an output roller 118, an oil applicator 120, a texturized yarn 122, a wiper guide 124, and a traverse guide 126, according to one embodiment.

In the embodiment of FIG. 1, the multi-pick yarn package 100 may be formed from two of the partially oriented polyester yarns 103 (POY) that may be oriented and texturized by a number of elements set forth in FIG. 1. The multi-pick yarn package 100 may be used to supply weft yarns (weft yarns may also be known as "fill," "picks," "woof" and/or "filling yarns") in any type of loom apparatus, including those with pick insertion mechanisms such as rapier, bullet, magnetic levitation bullet, water jet and/or air jet.

Figure 4:
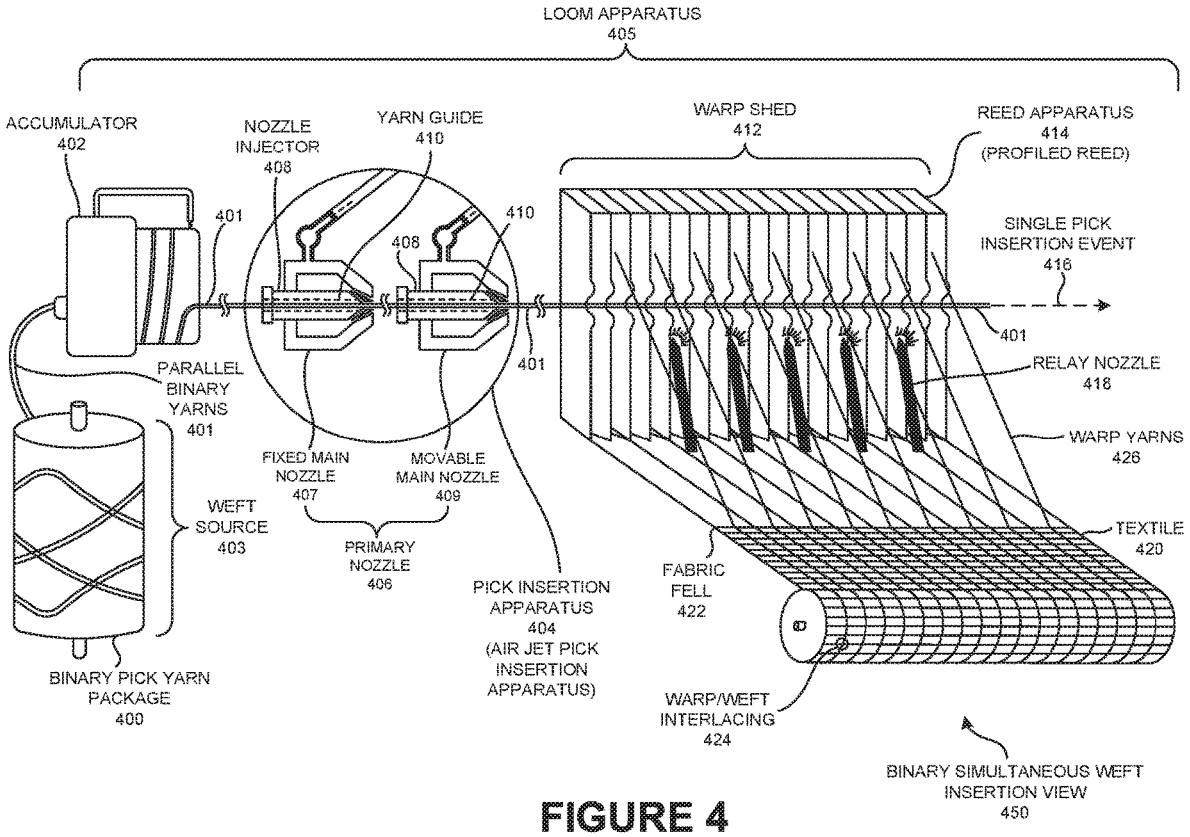
FIG. 4 is a binary simultaneous weft insertion view of an exemplarily use of the multi-pick yarn package of FIG. 3 in which two adjacent parallel yarns forming a binary pick yarn package are fed into an air jet loom apparatus such that a primary nozzle simultaneously propels two picks across a warp shed of the loom apparatus in a single pick insertion event, according to one or more embodiments.
Figure 5:
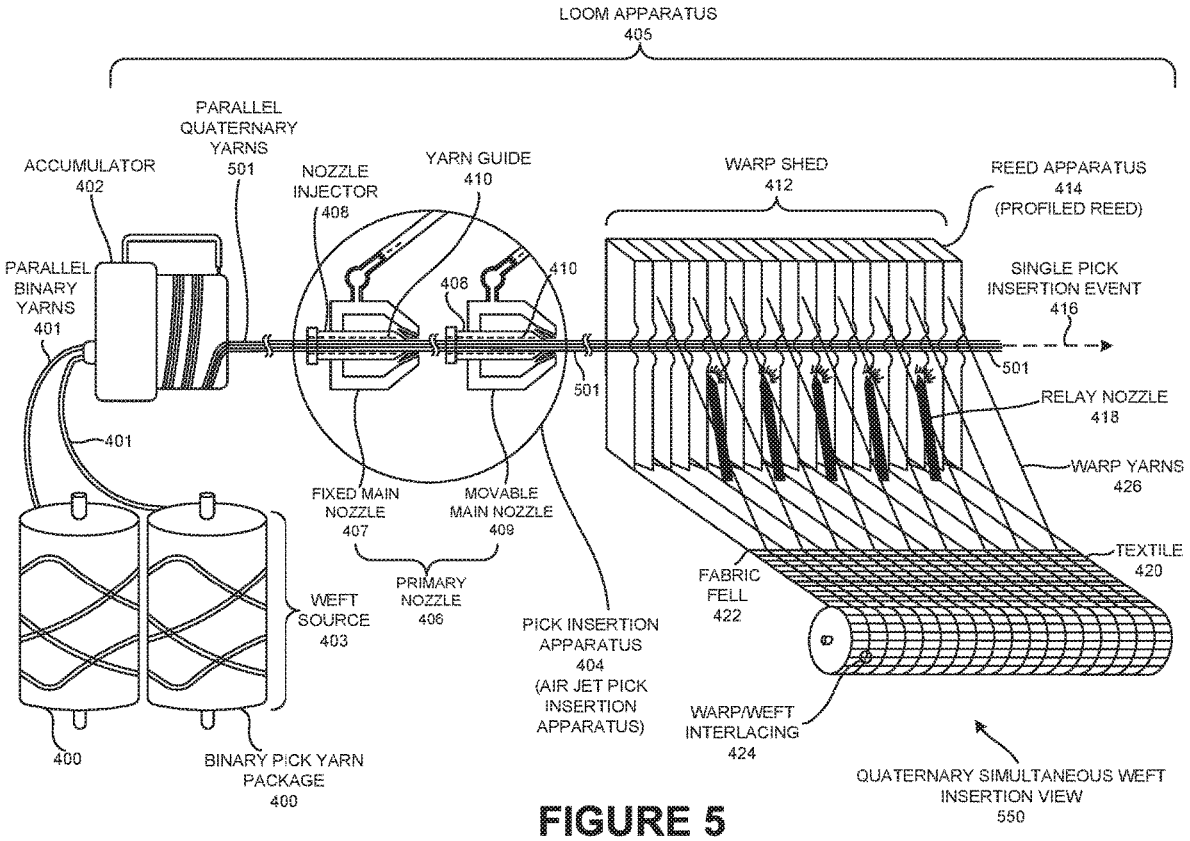
FIG. 5 is a quaternary simultaneous weft insertion view of an exemplarily use of more than one of the multi-pick yarn package of FIG. 3 in which two of the binary pick yarn packages of FIG. 4 are fed into an air jet loom apparatus such that a primary nozzle simultaneously propels four picks across a warp shed of the loom apparatus in a single pick insertion event, according to one or more embodiments.

In one preferred embodiment, and as described in conjunction with the description of FIG. 4 and FIG. 5, the loom may use an air jet pick insertion mechanism. The partially oriented polyester yarn 103 may be comprised of one or more extruded filaments of polyester.

The primary input roller 106 may draw the partially oriented polyester yarn 103 from the supply package 102. The secondary input roller 107, which may operate at a higher speed than the primary input roller 106, may then draw the partially oriented polyester yarn 103 from the primary input roller 106, forming the oriented polyester yarn 104. In a preferred embodiment, the secondary input roller 107 rotates at 1.7 times the speed of the primary input roller 106, according to one embodiment.

The oriented polyester yarn 104 may then be drawn through the primary heater 108. The primary heaters may be heated to a temperature between 50° C. and 200° C. In one preferred embodiment, the primary heater may be set to 190° C. After leaving the heater, the oriented polyester yarn 104 may then be exposed to the cooling plate 110 that may be set at a temperature between 0° C. and room temperature (e.g., about 20-25° C.). The cooling plate may also be set at temperatures between 25° C. and 40° C., and in one preferred embodiment 38° C.

The intermediate roller 114 may draw the oriented polyester yarn 104 from the cooling plate 110 to the friction twisting unit 112. The friction twisting unit 112 (e.g., an FTU) may twist/detwist the filaments within the oriented polyester yarn 104 such that it gains a texture (e.g., such that the resulting textile the oriented polyester yarn 104 may be woven into gains in "body" or heft) and may also provide a low stability interlacing in the weaving process, according to one embodiment.

The friction twisting unit 112 may also help to intermingle the polyester filaments that may comprise the oriented polyester yarn 104. The twist imparted by the friction twisting unit 112 may be translated through the oriented polyester yarn 104 back to the primary heater 108, which, in conjunction with the cooling plate 110, may "fix" the molecular structure of the twisted filaments of the oriented polyester yarn 104, imbuing it with a "memory" of torsion, according to one embodiment.

The intermediate roller 114 may convey the oriented polyester yarn 104 to the intermingling jet 115 that may apply a uniform air pressure to the oriented polyester yarn 104 to provide counter-twist to the friction twisting unit 112. The oriented polyester yarn 104 may then be heated by the secondary heater 116. The secondary heater 116 may be set to between 50° C. and 200° C. In one preferred embodiment, the intermingling jet 115 may be set to a pressure of 2 bars and the secondary heater 116 may be set to a temperature of 170° C., according to one embodiment.

The output roller 118 may convey the oriented polyester yarn 104 to the oil applicator 120. The oil applicator 120 may apply conning oil. The conning oil applied by the oil applicator 120 may act as a lubricant, reducing a friction between two or more yarns (e.g., several of the oriented polyester yarns 104) and between one or more yarns and a loom apparatus (e.g., metallic components the oriented polyester yarn 104 may contact). The conning oil may also minimize a static charge formation of synthetic yarns. The conning oil may be comprised of a mineral oil (e.g., a petroleum hydrocarbon), a moisture, an emulsifier (e.g., a non ionic surfactant, a fatty alcohol an ethoxylatlate, and/or a fatty acid), and/or a surfactant, according to one embodiment.

In addition, as will be shown and described in conjunction with the description of FIG. 4, the conning oil may help prevent a dissociation of the adjacent parallel yarns 101 when the adjacent parallel yarns 101 are propelled across a warp shed 408 during a single pick insertion event 416 of a loom apparatus 405, according to one embodiment. The rate at which the oil applicator 120 applies the conning oil may be adjusted to a minimum amount required to prevent dissociation of the adjacent parallel yarns 101 during a pick insertion event (e.g., the single pick insertion event 416 of FIG. 4), depending on the type of loom apparatus employed, according to one embodiment.

After conning oil may be applied by the oil applicator 120, the oriented polyester yarn 104 may be the texturized yarn 122 ready to be wound on a yarn supply package spindle (e.g., to become the multi-pick yarn package 100), according to one embodiment.

The wiper guide 124 may collect and convene multiple of the texturized yarns 122 such that the texturized yarns 122 become the adjacent parallel yarns 101. The adjacent parallel yarns 101 may then enter the traverse guide 126, which may wind the adjacent parallel yarns 101 onto a spool to form the multi-pick yarn package 100. The traverse guide 126 may wind the multi-pick yarn package 100 at a crossing wind angle of between 5-25° (e.g., the crossing wind angle 300 of FIG. 3, denoted θ), and at a type A shore hardness of between 45 and 85, according to one embodiment.

In one preferred embodiment, the number of texturized yarns 122 that may be convened by the wiper guide 124 to be wound onto the multi-pick yarn package 100 may be two (e.g., the binary pick yarn package 400 of FIG. 4). The partially oriented polyester yarn 103 may have a denier of 22.5 with 14 polyester filaments. In another preferred embodiment, the partially oriented polyester yarn 103 may have a denier of between 15 and 25.

One skilled in the art will know that denier may be a unit of measure for a linear mass density of a fiber, such measure defined as the mass in grams per 9000 meters of the fiber. The wiper guide 124 may substantially unite the texturized yarn 122 into the adjacent parallel yarns 101 such that, if considered a unitary yarn, the adjacent parallel yarns 101 may have 28 filaments and a denier of about 45, according to one embodiment. In contrast, if two of the partially oriented polyester yarns 103 with 14 filaments and a denier of 22.5 are twisted around one another, the twisted yarns, if considered a unitary yarn, may have a denier higher than 45 due to increased linear mass density of twisted fibers within a given distance. Yarns twisted in this fashion may also not qualify as independent yarns for calculating thread count according to industry standards of regulatory bodies, according to one embodiment.

Figure 2:
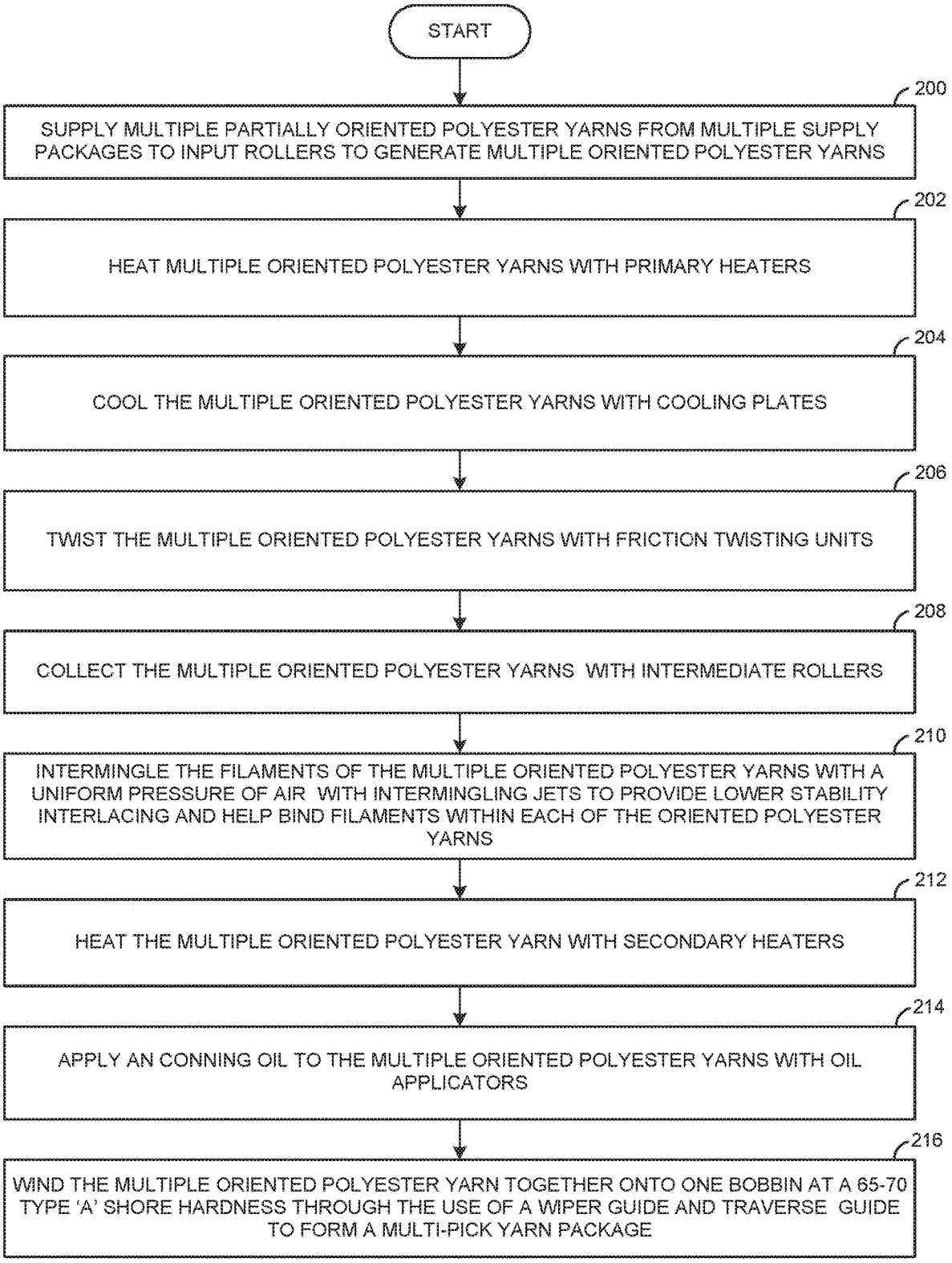
FIG. 2 is a process diagram showing the procedure by which the partially-oriented polyester yarn may be oriented, texturized and wound on a spindle to form the multi-pick yarn package of FIG. 1, according to one or more embodiments.

FIG. 2 is a process diagram showing the procedure by which the partially-oriented polyester yarn may be oriented, texturized and wound on a spindle to form the multi-pick yarn package of FIG. 1, according to one or more embodiments. In operation 200, multiple partially oriented polyester yarns (e.g., the partially oriented polyester yarns 103) may be supplied to input rollers to yield oriented yarn (e.g., the oriented polyester yarn 104). In operation 202, multiple oriented yarns are heated by two primary heaters, according to one embodiment.

In operation 204, the multiple oriented polyester yarns may be cooled by cooling plates. In operation 206, the multiple oriented polyester yarns may be twisted, individually, by friction twisting units. In operation 208, the oriented polyester yarns may be collected by intermediate rollers. In operation 210, the filaments of the oriented polyester yarns may be intermingled, individually, by a uniform pressure of air by intermingling jets to provide lower stability interlacing and help bind the filaments within each individual partially oriented polyester yarn 104, according to one embodiment.

In operation 212, the multiple of the oriented polyester yarns may be heated by secondary heaters, and in operation 214, the oriented polyester yarns may have conning oil applied to each yarn by oil applicators. In operation 216, the oriented polyester yarns (which may now be the texturized yarns 122), may be wound onto a single spindle at 45-85 type A shore hardness through the use of a wiper guide and traverse guide to form the multi-pick yarn package 100, according to one embodiment. One skilled in the art will know that type A shore hardness may be measured using the ASTM D2240 type A durometer scale.

Figure 3:
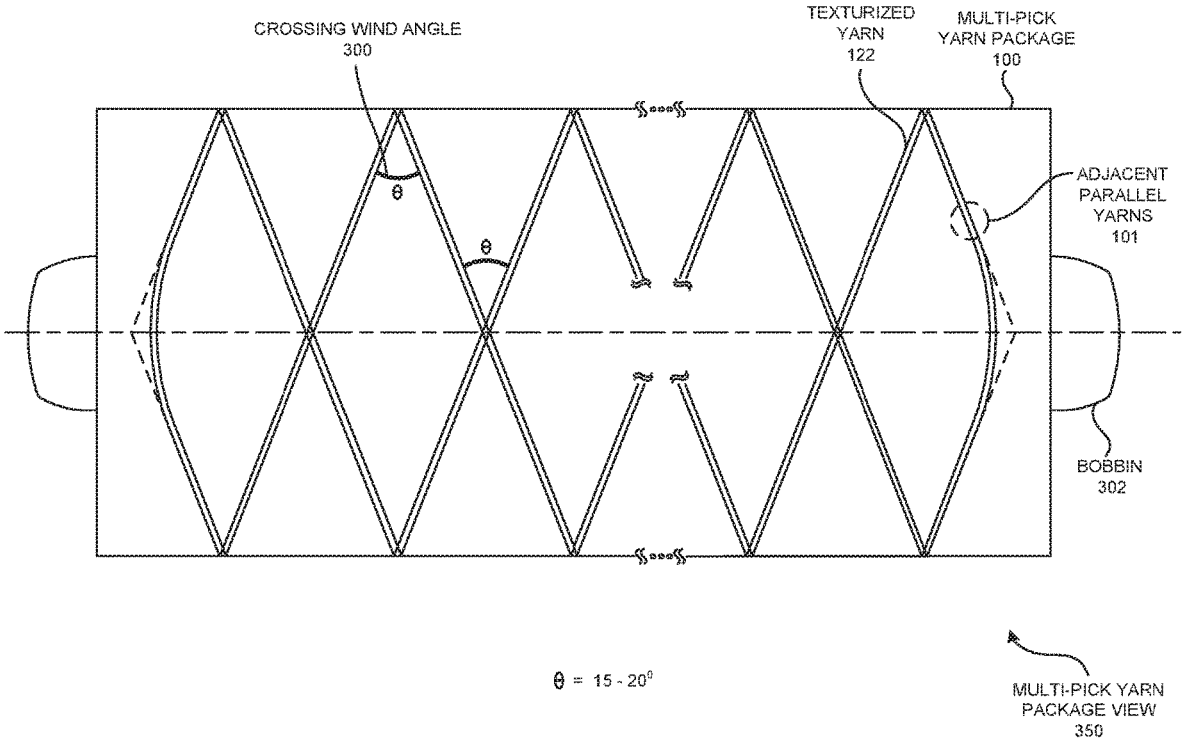
FIG. 3 is a multi-pick yarn package view showing the parallel configuration of the adjacent texturized yarns and their crossing wind angle within the multi-pick yarn package, imposed by the wiper guide and traverse guide of FIG. 1, respectively, according to one or more embodiments.

FIG. 3 is a multi-pick yarn package view 350 showing the parallel configuration of the adjacent texturized yarns and their crossing wind angle within the multi-pick yarn package, imposed by the wiper guide and traverse guide of FIG. 1, respectively, according to one or more embodiments. Particularly, FIG. 3 further illustrates a crossing wind angle 300 (denoted θ), and a bobbin 302.

In the embodiment of FIG. 3, the multi-pick yarn package 100 is shown wound with the adjacent parallel yarns 101 comprising two of the texturized yarns 122. The adjacent parallel yarns 101 may be wound on a bobbin 302. The bobbin may also be a strait or a tapered bobbin. The crossing wind angle 300 may be the acute angle formed at the intersection between the adjacent parallel yarns 101 deposited in a first pass of the traverse guide 126 and the adjacent parallel yarns 101 in a subsequent pass of the traverse guide 126, as shown in FIG. 3, according to one embodiment.

FIG. 4 is a binary simultaneous weft insertion view 450 of an exemplary use of the multi-pick yarn package of FIG. 3 in which two adjacent parallel yarns forming a binary pick yarn package are fed into an air jet loom apparatus such that a primary nozzle simultaneously propels two picks across a warp shed of the loom apparatus in a single pick insertion event, according to one or more embodiments.

Particularly, FIG. 4 further illustrates a binary pick yarn package 400 (e.g., the multi-pick yarn package 100 wound with two of the texturized yarns 122), a parallel binary yarns 401, an accumulator 402, a weft source 403 a cross section of a pick insertion apparatus 404 (e.g., an air jet pick insertion apparatus), a primary nozzle 406 comprised of a fixed main nozzle 407 and a moveable main nozzle 409, a nozzle injector 408, a yarn guide 410, a warp shed 412, a reed apparatus 414 (e.g., a profiled reed of the air jet loom), a single pick insertion event 416, a relay nozzle 418, a textile 420, a fabric fell 422, and a warp/weft interlacing 424, according to one embodiment.

The loom apparatus 405 (e.g., a rapier loom, a bullet loom, an air jet loom) may accept a weft source 403 supplying the adjacent parallel yarns 101. In the embodiment of FIG. 4, the loom apparatus 405 may be an air jet loom apparatus (e.g., a Picanol Omni Plus®, a Picanol Omni Plus® 800) and the weft source 403 may be the binary pick yarn package 400, which is the multi-pick yarn package 100 wound with two of the adjacent parallel yarns 101 in accordance with the process of FIG. 1 and FIG. 2. The two of the adjacent parallel yarns 101 drawn from the binary pick yarn package 400 and fed into the loom apparatus 405 may be referred to as the parallel binary yarns 401, according to one embodiment.

The parallel binary yarns 401 may be fed into the air jet loom apparatus and the elements thereof in accordance with ordinary practice to one skilled in the art. FIG. 4 illustrates some of the elements of an air jet loom apparatus that may interact with the parallel binary yarns 401 such as the accumulator 402, the primary nozzle 406, the fixed main nozzle 407, the moveable main nozzle 409, the profiled reed (e.g., the reed apparatus 414 of the air jet loom) and the relay nozzles 418, according to one embodiment.

For example, the parallel binary yarns 401 from the binary pick yarn package 400 may be fed into an accumulator 402 of the air jet pick insertion apparatus. The accumulator 402 may be designed to collect and hold in reserve between each of the single pick insertion events 416 a length of the parallel binary yarns 401 needed to cross the warp shed 412 with a minimal unwinding resistance. Next, the parallel binary yarns 401 may pass into the pick insertion apparatus 404 (in the embodiment of FIG. 4, a cross section of an air jet pick insertion apparatus is shown), according to one embodiment.

The primary nozzle 406 may be comprised of one or more individual nozzles. In the embodiment of FIG. 4, the primary nozzle 406 is comprised of the fixed main nozzle 407 and the moveable main nozzle 409. The primary nozzle 406 may accept the adjacent parallel yarns 101 through a yarn guide 410 of a nozzle injector 408 that may be present in both the fixed main nozzle 407 and the moveable main nozzle 409. In an alternate embodiment, the primary nozzle 406 may be comprised of a single nozzle, according to one embodiment.

Air entering the fixed main nozzle 407 and/or the moveable main nozzle 409 may drive back the nozzle injector 408 and propel the parallel binary yarns 401 across the warp shed 412 of the loom apparatus 405. The airflow of the primary nozzle may be adjusted to between 12 $Nm^3$/hour to 14 $Nm^3$/hour. The airflow of the fixed main nozzle 407 may be adjusted to between 12 $Nm^3$/hour to 14 $Nm^3$/hour and a drive time of the relay valves (not shown in the embodiment of FIG. 4) may be adjusted to between 90° and 135°, according to one embodiment.

The parallel binary yarns 401 may enter the warp shed 412 of the loom apparatus 405. With the air jet pick insertion apparatus of FIG. 4, the parallel binary yarns 401 may be aided in crossing the warp shed 412 by a plurality of relay nozzles 418 associated with a reed apparatus 414 that, to aid in gaseous conveyance of the picks, may be a profiled reed. Each of the relay nozzles 418 may be adjusted to between 100 mbar to 14 mbar, according to one embodiment.

The parallel binary yarns 401 drawn from the multi-pick yarn package may cross the warp shed 412 in the single pick insertion event 416. The single pick insertion event 416 is the operation and/or process of the pick insertion apparatus 404 that is known in the art to be ordinarily associated with the projection of yarns (or yarns comprised of multiple yarns twisted together) across the warp shed 412, according to one embodiment.

For example, the yarn threaded through the yarn guide 410 of the primary nozzle 406 may be a single yarn that yarn may be projected across the warp shed 412 of the loom apparatus 405 in a single burst (or rapid timed succession of bursts) of pressurized air from a single of the primary nozzles 406. In another example, the single pick insertion event 416 may be one cycle of a rapier arm (e.g., a rapier pick insertion apparatus) through the warp shed 412, according to one embodiment.

Upon crossing the warp shed 412 of the loom apparatus 405, the reed apparatus 414 may "beat up" (e.g., perform a beat up motion) the parallel binary yarns 401, forcing them into the fabric fell 422 (also known as "the fell of the cloth") of the textile 420 that the loom apparatus 405 may be producing. The beat up motion of the reed apparatus 414 may form the warp/weft interlacing 424 of the warp yarns 426 and the parallel binary yarns 401 (e.g., the weft yarns), producing an incremental length of the textile 420, according to one embodiment.

FIG. 5 is a quaternary simultaneous weft insertion view 550 of an exemplarily use of more than one of the multi-pick yarn package of FIG. 3 in which two of the binary pick yarn packages of FIG. 4 are fed into an air jet loom apparatus such that a primary nozzle simultaneously propels four picks across a warp shed of the loom apparatus in a single pick insertion event, according to one or more embodiments. Particularly, FIG. 5 further illustrates the use of a parallel quaternary yarns 501, according to one embodiment.

In FIG. 5, the weft source 403 may be two of the binary pick yarn packages 400 of FIG. 4, each supplying two of the parallel binary yarns 401 (e.g., four of the texturized yarns 122), that may be fed into the pick insertion apparatus 404 of the loom apparatus 405 (in the embodiment of FIG. 5, the air jet loom) such that the two parallel binary yarns 401 may become the parallel quaternary yarn 501. Therefore, four of the texturized yarns 122 may be threaded through the yarn guide 410 of the primary nozzle 406, and all four of the texturized yarns 122 may be projected across the warp shed 412 in a single burst of pressurized air from the primary nozzle 406. To further illustrate, the four of the texturized yarns 122 (e.g., the parallel quaternary yarns 501) shown in FIG. 5 may be substantially adjacent and parallel as opposed to twisted around one another, according to one embodiment.

In an alternate embodiment not shown in FIG. 4 or FIG. 5, the weft source 403 of the loom apparatus 405 may be three or more of the multi-pick yarn packages 100. For example, the weft source 403 may be four binary pick yarn packages 400. In such a case, eight of the texturized yarns 122 may be projected across the warp shed 412 during the single pick insertion event 416. In one embodiment, the highest thread counts (e.g., 800, 1200) may be yielded by using four of the binary pick yarn packages 400 as the weft source 403, according to one embodiment.

Figure 9:
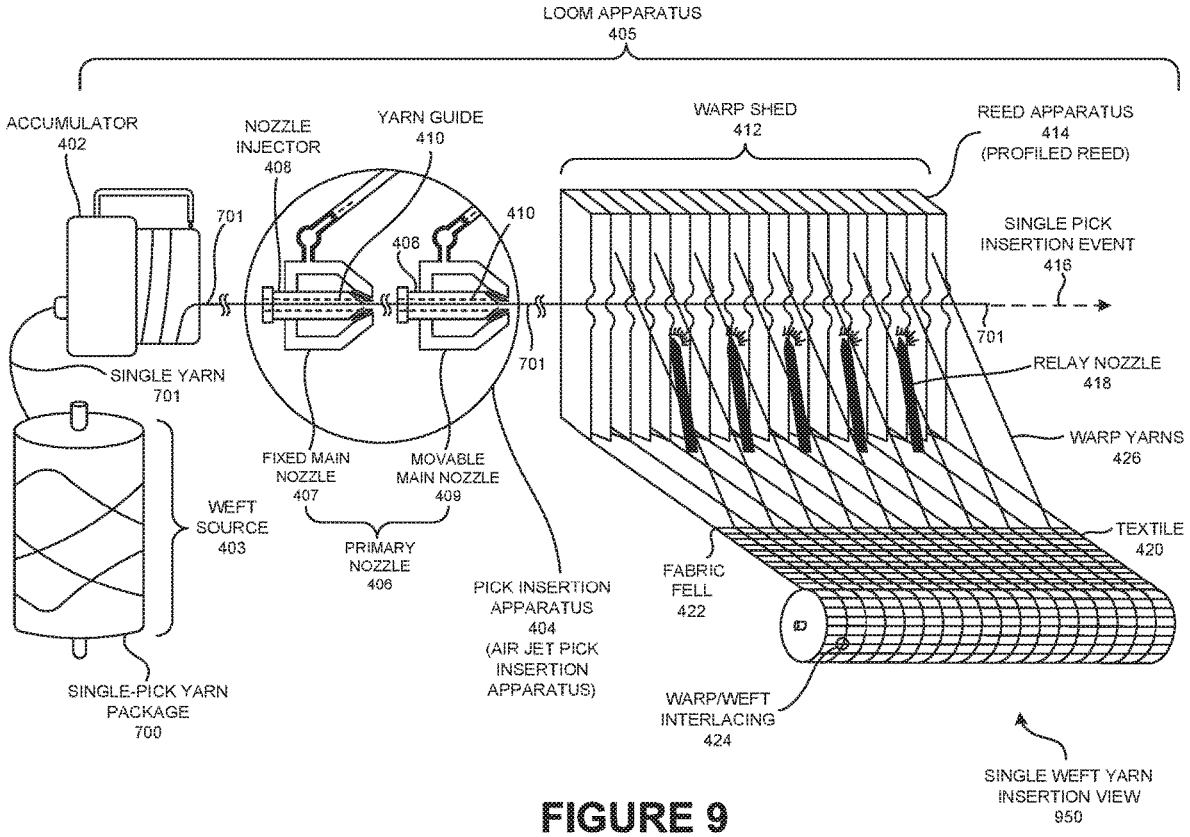
FIG. 9 is a single weft yarn insertion view of an exemplarily use of the single-pick yarn package of FIG. 7 in which single yarn forming a pick yarn package is fed into an air jet loom apparatus such that a primary nozzle propels one pick across a warp shed of the loom apparatus in a single pick insertion event, according to one or more embodiments.

In a further example embodiment as shown in FIG. 9, the weft source 403 of the loom apparatus 405 may be one of the single-pick yarn package(s) 700. In such a case, single yarn 701 of the texturized yarns 122 may be projected across the warp shed 412 during the single pick insertion event 416. In one embodiment, the highest thread counts (e.g., 800, 1200) may be yielded by using one of the single-pick yarn packages 700 as the weft source 403, according to one embodiment.

In yet another embodiment not shown in FIG. 4 or FIG. 5, there may also be an odd number of the texturized yarns 122 (e.g., a tertiary parallel yarns) propelled across the warp shed 412 in the single pick insertion event 416, for example of the weft source 403 was composed of a the single-pick yarn package (e.g., single-pick yarn package 700) along with one of the binary pick yarn packages 400 of FIG. 4. The tertiary parallel yarns may also result where the multi-pick yarn package 100 is wound with three of the texturized yarns 122 by the process of FIG. 1 and FIG. 2. In addition, the deniers of the texturized yarns 122 wound on the multi-pick yarn package 100 may be heterogeneous, according to one embodiment.

It will be recognized to one skilled in the art that the loom apparatus 405 may have tandem, multiple, or redundancies of the pick insertion apparatuses 404 which may insert yarns in an equal number of the single pick insertion events 416. For example, an air jet loom apparatus may have multiple of the primary nozzles 406 (e.g., four, eight). A number of the primary nozzles 406 may each insert the adjacent parallel yarns 101 in a corresponding number of the single pick insertion event(s) 416 before the reed apparatus 414 beats the adjacent parallel yarns 101 into the fabric fell 422, according to one embodiment.

For example, an air jet loom utilizing six of the primary nozzles 406, with each of the primary nozzles 406 supplied by one of the binary pick yarn packages 400, may project six of the parallel binary yarns 401 across the warp shed 412 in six of the single pick insertion events 416 that are distinct. In such an example, twelve of the texturized yarns 122 would be beat into the fabric fell 422 during the beat up motion of the reed apparatus 414. In one embodiment, the highest thread counts (e.g., 800, 1200) may be yielded by using multiple of the pick insertion apparatuses 404 (e.g., four, each projecting two of the adjacent parallel yarns 101 across the warp shed 412 before the reed apparatus 414 carries out the beat-up motion), according to one embodiment.

Figure 6:
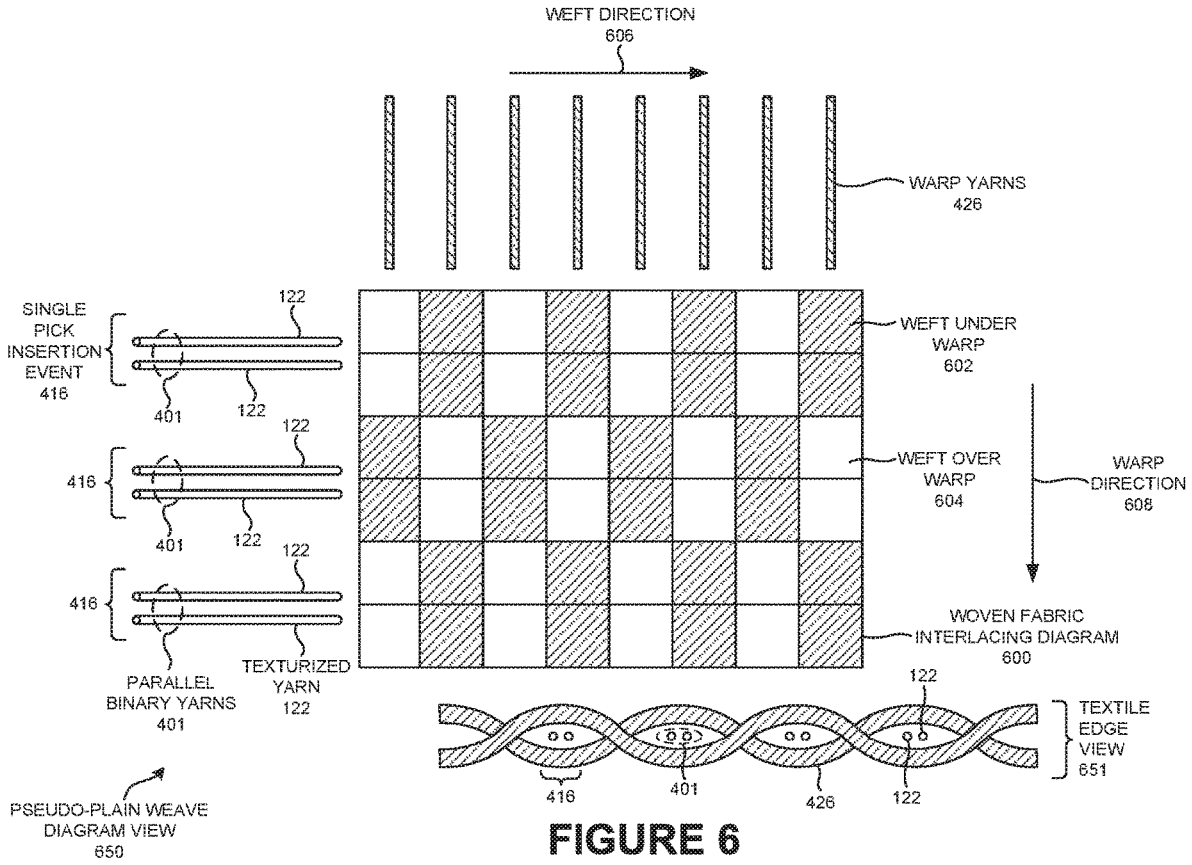
FIG. 6 is a pseudo-plain weave diagram view and textile edge view that demonstrates the resulting 1×2 weave when the adjacent parallel yarn pair from the binary pick yarn package of FIG. 4 is conveyed across the warp shed of a loom apparatus configured to interlace warp and weft yarns after a single pick insertion event, according to one or more embodiments.

FIG. 6 is a pseudo-plain weave diagram view 650 and textile edge view 651 that demonstrates the resulting 1×2 weave when the adjacent parallel yarn pair from the binary pick yarn package of FIG. 4 is conveyed across the warp shed of a loom apparatus configured to interlace warp and weft yarns after a single pick insertion event, according to one or more embodiments. Particularly, FIG. 6 further illustrates a woven fabric interlacing diagram 600 having sections with a weft under warp 602, a weft over warp 604, a weft direction 606, and a warp direction 608.

FIG. 6 shows the woven fabric interlacing diagram 600 that may result when a loom apparatus (e.g., the loom apparatus 405) is configured to interlace the warp yarns 426 and the adjacent parallel yarns 101 drawn from the binary pick yarn package 400 of FIG. 4 after a single pick insertion event 416. Because two of the texturized yarns 122 may be wound on the binary pick yarn package 400, the resulting woven fabric interlacing may be a "1 by 2" weave with the weft under warp 602 and weft over warp 604 alternating after each of the warp yarns 426 in the weft direction 606 and alternating after each two of the texturized yarns 122 in the warp direction 608. For example, while the loom apparatus may be traditionally configured to produce a textile with a plain wave (e.g., having a woven fabric interlacing diagram 600 of alternating weft under warp 602 and weft over warp 604 in both the weft direction 606 and the warp direction 608, similar to chess board), the result will be a 1 by 2 "pseudo-plain weave" woven fabric interlacing diagram 600 of FIG. 6, according to one embodiment.

The warp yarns 426 of a textile produced (e.g., the textile 420) using the multi-pick yarn package 100 may be comprised of natural or synthetic fibers, and the weft yarns may be polyester weft yarns (e.g., the adjacent parallel yarns 101 comprised of multiple of the texturized yarns 122). In one preferred embodiment, the warp yarns may be made of cotton, according to one embodiment.

The textile produced from the multi-pick yarn package 100 may have between 90 and 235 warp yarn ends per inch, between 100 and 965 picks per inch, and may have a warp-to-fill ratio between 1:2 and 1:4 (in other words, 1 warp yarn per every 4 weft yarns). The textile produced using the multi-pick yarn package 100 may have a thread count of between 190 to 1200, a minimum tensile strength of 17.0 kg to 65.0 kg (about 37.5 lbs to 143.5 lbs) in the warp direction 608, and a minimum tensile strength of 11.5 kg to 100.0 kg (about 25.4 lbs to 220.7 lbs) in the weft direction 606. In one or more embodiments the textile manufactured using the multi-pick yarn package 100 may have a composition of 45-49% texturized polyester yarn (e.g., the texturized yarn 122) and 51-65% cotton yarn, according to one embodiment.

The partially oriented polyester yarn 103 (that becomes the texturized yarn 122 after undergoing operations 200 through 216 of FIG. 2) may have multiple filaments and may have a denier of between 15 and 50. In one preferred embodiment, the partially oriented polyester yarn 103 may have about a denier of about 20 and have about 14 filaments, according to one embodiment.

The resulting fabric produced may be of exceptionally high quality compared to prior-art cotton-synthetic hybrid weaves due to its high thread count. To further increase quality and comfort of the textile, the fabric may be finished by brushing the surface to increase softness (a process known as "peaching" or "peach finishing"). In addition, various other finishing methods may be used in association with the textile produced from the multi-pick yarn package 100 to increase the resulting textile's quality, according to one embodiment.

Figure 7:
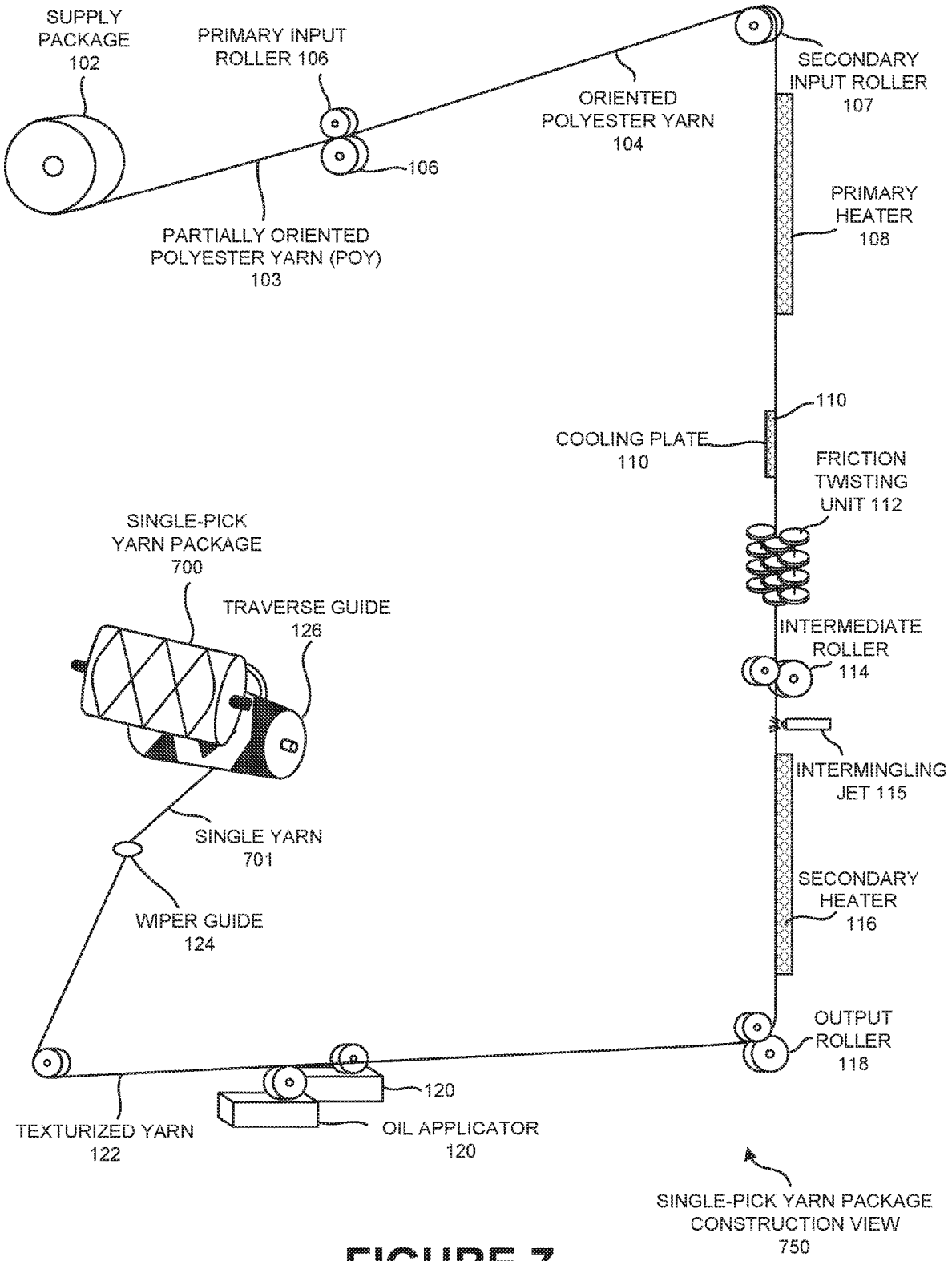
FIG. 7 is a single-pick yarn package construction view in which single discrete partially-oriented polyester yarn is oriented, texturized, convened by a wiper guide, and then wound onto a single multi-pick yarn package, according to one or more embodiments.

FIG. 7 is a single-pick yarn package construction view 750 in which one discrete partially-oriented polyester yarn is oriented, texturized, convened by a wiper guide, and then wound onto a single-pick yarn package, according to one or more embodiments. Particularly, FIG. 7 builds on FIGS. 1 through 6 and further adds a single-pick yarn package 700 and a single yarn 701, according to one embodiment.

In the embodiment of FIG. 7, the single-pick yarn package 700 may be formed from single partially oriented polyester yarn 103 (POY) that may be oriented and texturized by a number of elements set forth in FIG. 1. The single-pick yarn package 700 may be used to supply weft yarn (weft yarns may also be known as "fill," "picks," "woof" and/or "filling yarns") in any type of loom apparatus, including those with pick insertion mechanisms such as rapier, bullet, magnetic levitation bullet, water jet and/or air jet. In one preferred embodiment, and as described in conjunction with the description of FIG. 8 and FIG. 9, the loom may use an air jet pick insertion mechanism. The partially oriented polyester yarn 103 may be comprised of one or more extruded filaments of polyester, according to one embodiment.

In one more embodiment of FIG. 7, the single-pick yarn package 700 may be formed from single partially oriented polyester yarn 103 (POY) that may be oriented and texturized by a number of elements set forth and as described in FIG. 1. In addition, as will be shown and described in conjunction with the description of FIG. 9, the conning oil may help prevent a dissociation of the single yarn 701. The rate at which the oil applicator 120 applies the conning oil may be adjusted to a minimum amount required to prevent dissociation of the single yarn 701 during a pick insertion event (e.g., the single pick insertion event 416 of FIG. 9), depending on the type of loom apparatus employed, according to one embodiment.

After conning oil may be applied by the oil applicator 120, the oriented polyester yarn 104 may be the texturized yarn 122 ready to be wound on a yarn supply package spindle (e.g., to become the single-pick yarn package 700). The wiper guide 124 may collect and convene multiple of the texturized yarns 122 such that the texturized yarns 122 become the single yarn 701. The single yarn 701 may then enter the traverse guide 126, which may wind the single yarn 701 onto a spool to form the single-pick yarn package 700. The traverse guide 126 may wind the single-pick yarn package 700 at a crossing wind angle of between 5-25° (e.g., the crossing wind angle 300 of FIG. 8, denoted θ). In one preferred embodiment, the number of texturized yarns 122 that may be convened by the wiper guide 124 to be would onto the single-pick yarn package 700 may be two (e.g., the binary pick yarn package 400 of FIG. 4), according to one embodiment.

In one preferred embodiment, the partially oriented polyester yarn 103 may have a denier of 22.5 with 14 polyester filaments. In another preferred embodiment, the partially oriented polyester yarn 103 may have a denier of between 15 and 25. One skilled in the art will know that denier may be a unit of measure for a linear mass density of a fiber, such measure defined as the mass in grams per 9000 meters of the fiber, according to one embodiment.

The wiper guide 124 may substantially unite the texturized yarn 122 into the single yarn 701 such that, if considered a unitary yarn, the single yarn 701 may have 28 filaments and a denier of about 45. In contrast, if two of the partially oriented polyester yarns 103 with 14 filaments and a denier of 22.5 are twisted around one another, the twisted yarns, if considered a unitary yarn, may have a denier higher than 45 due to increased linear mass density of twisted fibers within a given distance, according to one embodiment.

Figure 8:
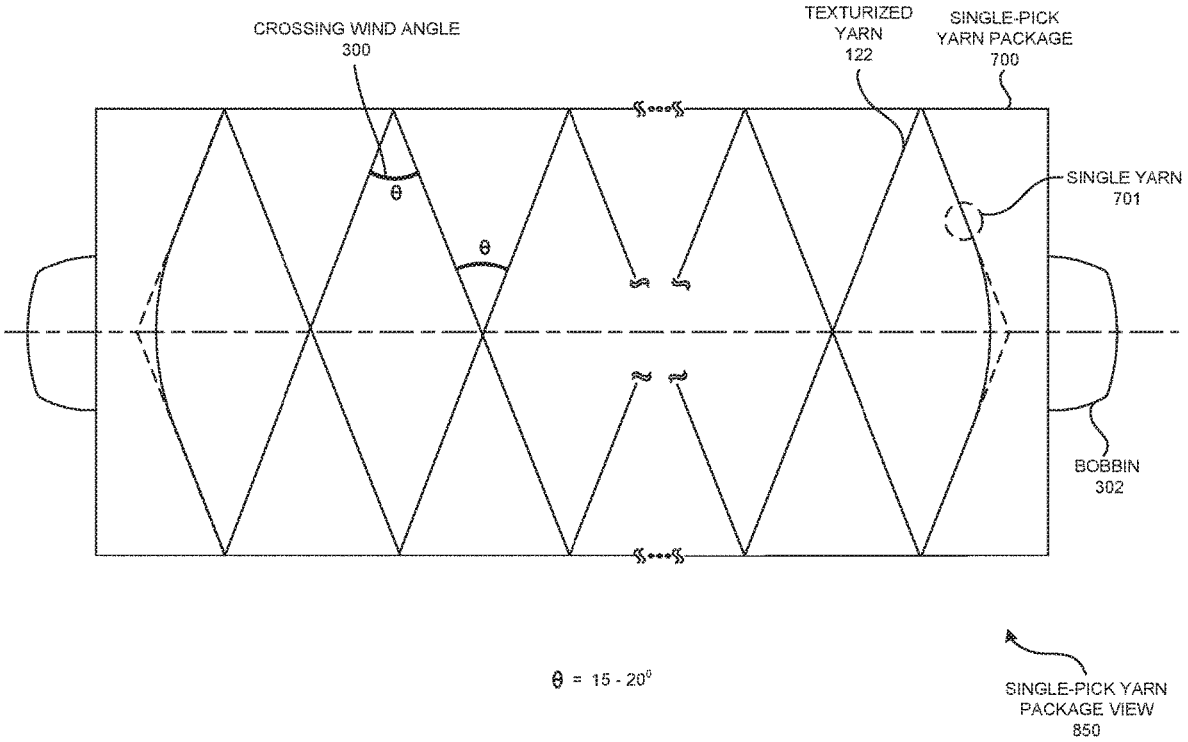
FIG. 8 is a single-pick yarn package view showing the configuration of the texturized single yarn and the crossing wind angle within the single-pick yarn package, imposed by the wiper guide and traverse guide of FIG. 7, respectively, according to one or more embodiments.

FIG. 8 is a single-pick yarn package view 850 showing the configuration of the single texturized yarn and the crossing wind angle within the single-pick yarn package, imposed by the wiper guide and traverse guide of FIG. 7, respectively, according to one or more embodiments. Particularly, FIG. 8 further illustrates a crossing wind angle 300 (denoted θ), and a bobbin 302, according to one embodiment.

In the embodiment of FIG. 8, the single-pick yarn package 700 is shown wound with the single yarn 701 comprising one of the texturized yarns 122. The single yarn 701 may be wound on a bobbin 302. The bobbin may also be a straight or a tapered bobbin. The crossing wind angle 300 may be the acute angle formed at the intersection between the single yarn 701 deposited in a first pass of the traverse guide 126 and the single yarn 701 in a subsequent pass of the traverse guide 126, as shown in FIG. 8, according to one embodiment.

FIG. 9 is a single weft insertion view of an exemplarily use of the single-pick yarn package 700 of FIG. 8 in which single yarn 701 forming a pick yarn package is fed into an air jet loom apparatus such that a primary nozzle propels one pick across a warp shed of the loom apparatus in a single pick insertion event 416, according to one or more embodiments. Particularly, FIG. 9 builds on FIGS. 1 through 8 and further adds a single pick yarn package 700 (e.g., the multi-pick yarn package 100 wound with one of the texturized yarn 122) and a single yarn 701.

The loom apparatus 405 (e.g., a rapier loom, a bullet loom, an air jet loom) may accept a weft source 403 supplying the single yarn 701. In the embodiment of FIG. 9, the loom apparatus 405 may be an air jet loom apparatus (e.g., a Picanol Omni Plus®, a Picanol Omni Plus® 800) and the weft source 403 may be the single-pick yarn package 700, which is the single-pick yarn package 700 wound with single yarn 701 in accordance with the process of FIG. 7 and FIG. 8. The yarn drawn from the single-pick yarn package 700 and fed into the loom apparatus 405 may be referred to as the single yarn 701, according to one embodiment.

The single yarn 701 may be fed into the air jet loom apparatus and the elements thereof in accordance with ordinary practice to one skilled in the art. FIG. 7 illustrates some of the elements of an air jet loom apparatus that may interact with the single yarn 701 such as the accumulator 402, the primary nozzle 406, the fixed main nozzle 408, the moveable main nozzle 409, the profiled reed (e.g., the reed apparatus 414 of the air jet loom) and the relay nozzles 418, according to one embodiment.

For example, the single yarn 701 from the single pick yarn package 700 may be fed into an accumulator 402 of the air jet pick insertion apparatus. The accumulator 402 may be designed to collect and hold in reserve between each of the single pick insertion events 416 a length of the parallel binary yarns 401 needed to cross the warp shed 412 with a minimal unwinding resistance. Next, the single yarn 701 may pass into the pick insertion apparatus 404 (in the embodiment of FIG. 9, a cross-section of an air jet pick insertion apparatus is shown), according to one embodiment.

The primary nozzle 406 may be comprised of one or more individual nozzles. In the embodiment of FIG. 9, the primary nozzle 406 is comprised of the fixed main nozzle 408 and the moveable main nozzle 409. The primary nozzle 406 may accept the adjacent parallel yarns 101 through a yarn guide 410 of a nozzle injector 408 that may be present in both the fixed main nozzle 408 and the moveable main nozzle 409. In an alternate embodiment, the primary nozzle 406 may be comprised of a single nozzle, according to one embodiment.

Air entering the fixed main nozzle 408 and/or the moveable main nozzle 409 may drive back the nozzle injector 408 and propel the parallel binary yarns 401 across the warp shed 412 of the loom apparatus 405. The airflow of the primary nozzle may be adjusted to between 12 $Nm^3$/hour to 14 $Nm^3$/hour. The airflow of the fixed main nozzle 408 may be adjusted to between 12 $Nm^3$/hour to 14 $Nm^3$/hour and a drive time of the relay valves (not shown in the embodiment of FIG. 4) may be adjusted to between 90° and 135°, according to one embodiment.

The single yarn 701 may enter the warp shed 412 of the loom apparatus 405. With the air jet pick insertion apparatus of FIG. 9, the single yarn 701 may be aided in crossing the warp shed 412 by a plurality of relay nozzles 418 associated with a reed apparatus 414 that, to aid in gaseous conveyance of the picks, may be a profiled reed. Each of the relay nozzles 418 may be adjusted to between 100 mbar to 14 mbar, according to one embodiment.

The single yarn 701 drawn from the single-pick yarn package may cross the warp shed 412 in the single pick insertion event 416. The single pick insertion event 416 is the operation and/or process of the pick insertion apparatus 404 that is known in the art to be ordinarily associated with the projection of yarns (or yarns comprised of multiple yarns twisted together) across the warp shed 412. For example, the yarn threaded through the yarn guide 410 of the primary nozzle 406 may be a single yarn (e.g., single yarn 701) that yarn may be projected across the warp shed 412 of the loom apparatus 405 in a single burst (or rapid timed succession of bursts) of pressurized air from a single of the primary nozzles 406. In another example, the single pick insertion event 416 may be one cycle of a rapier arm (e.g., a rapier pick insertion apparatus) through the warp shed 412, according to one embodiment.

Upon crossing the warp shed 412 of the loom apparatus 405, the reed apparatus 414 may "beat up" (e.g., perform a beat up motion) the parallel binary yarns 401, forcing them into the fabric fell 422 (also known as "the fell of the cloth") of the textile 420 that the loom apparatus 405 may be producing. The beat up motion of the reed apparatus 414 may form the warp/weft interlacing 424 of the warp yarns 426 and the single yarn 701 (e.g., the weft yarn), producing an incremental length of the textile 420, according to one embodiment.

In one embodiment, a woven textile fabric includes from 90 to 235 ends per inch warp yarns and from 100 to 965 picks per inch multi-filament polyester weft yarns. The warp yarns may be made of a cotton material, and may have a total thread count is from 190 to 1000. The woven textile fabric may be made of multi-filament polyester yarns having a denier of 20 to 65. The woven textile fabric may have multi-filament polyester yarns having a denier of 15 to 35. The woven textile fabric may also have multi-filament polyester yarns have a denier of 20 to 25.

Additionally, the multi-filament polyester yarns may contain 10 to 30 filaments each. The woven textile fabric may have a minimum tensile strength in a warp direction of 17 kilograms to 65 kilograms and a minimum tensile strength in a weft direction of 11.5 kilograms to 100 kilograms. The woven textile fabric may have a warp-to-fill ratio that is between 1:2 to 1:4, according to one embodiment.

In another embodiment, a method of weaving a fabric includes drawing multiple polyester weft yarns from a weft source to a pick insertion apparatus of a loom apparatus. The method also includes conveying by the pick insertion apparatus the multiple polyester weft yarns across a warp shed of the loom apparatus through a set of warp yarns in a single pick insertion event of the pick insertion apparatus of the loom apparatus and beating the multiple polyester weft yarns into a fell of the fabric with a reed apparatus of the loom apparatus such that the set of warp yarns and/or the multiple polyester weft yarns become interlaced into a woven textile fabric. The method forms the woven textile having from 90 to 235 ends per inch warp yarns and from 100 to 965 picks per inch multi-filament polyester weft yarns, according to one embodiment.

The denier of the polyester weft yarns may be between 15 and 50. The weft source may be a weft yarn package in which the multiple polyester weft yarns are wound using a single pick insertion and in a substantially parallel form to one another and substantially adjacent to one another to enable the simultaneous inserting of the multiple polyester weft yarns during the single pick insertion event of the pick insertion apparatus of the loom apparatus, according to one embodiment.

Further, the number of the multiple polyester weft yarns wound substantially parallel to one another and substantially adjacent to one another on the weft yarn package may be at least two. The number of the multiple polyester weft yarns conveyed by the pick insertion apparatus across the warp shed of the loom apparatus through the set of warp yarns in the single pick insertion event of the pick insertion apparatus of the loom apparatus may be between two and eight, according to one embodiment.

Additionally, the pick insertion apparatus of the loom apparatus may be an air jet pick insertion apparatus. The multiple polyester weft yarns may be wound on the yarn package at an angle of between 5 and/or 25 degrees to enable the simultaneous inserting of the multiple polyester weft yarns during the single pick insertion event of the pick insertion apparatus of the loom apparatus. Additionally, the multiple polyester weft yarns may be wound on the yarn package at a type A shore hardness of between 45 to 85 to enable the simultaneous inserting of the multiple polyester weft yarns during the single pick insertion event of the pick insertion apparatus of the loom apparatus, according to one embodiment.

Further, the multiple polyester weft yarns may be treated with a conning oil comprising a petroleum hydrocarbon, an emulsifier and/or a surfactant to enable the simultaneous inserting of the multiple polyester weft yarns during the single pick insertion event of the pick insertion apparatus of the loom apparatus. The pick insertion apparatus of the loom apparatus may be a rapier insertion apparatus and/or a bullet insertion apparatus, according to one embodiment.

An airflow of a primary nozzle and/or a fixed nozzle of the air jet pick insertion apparatus pick insertion apparatus may be adjusted to between 12 $Nm^3$/hr to 14 $Nm^3$/hr to enable the simultaneous inserting of the multiple polyester weft yarns during the single pick insertion event of the pick insertion apparatus of the loom apparatus, according to one embodiment.

The airflow of each relay nozzle in the air jet pick insertion apparatus pick insertion apparatus may be adjusted to between 100 and/or 140 millibars to enable the simultaneous inserting of the multiple polyester weft yarns during the single pick insertion event of the pick insertion apparatus of the loom apparatus. A drive time of a drive time of a relay valve of the air jet pick insertion apparatus pick insertion apparatus may be adjusted to between 90 degrees and/or 135 degrees to enable the simultaneous inserting of the multiple polyester weft yarns during the single pick insertion event of the pick insertion apparatus of the loom apparatus, and the multiple polyester weft yarns may have a denier of 22.5 with 14 filaments, according to one embodiment.

The multiple polyester weft yarns may be treated with a primary heater heated to approximately 180 degrees Celsius to enable the simultaneous inserting of the multiple polyester weft yarns during the single pick insertion event of the pick insertion apparatus of the loom apparatus, and the multiple polyester weft yarn may be treated with a cooling plate at a temperature of between 0 and 25 degrees Celsius subsequent to the treating with the primary heater, according to one embodiment.

In yet another embodiment, a bedding material having the combination of the "feel" and absorption characteristics of cotton and the durability characteristics of polyester with multi-filament polyester weft yarns having a denier of between 15 and 50 and cotton warp yarns woven in a loom apparatus that simultaneously inserts multiple of the multi-filament polyester weft yarns during a single pick insertion event of the loom apparatus in a parallel fashion such that each of the multiple polyester weft yarns maintain a physical adjacency between each other during the single pick insertion event, increasing the thread count of a woven fabric of the bedding material based on the usage of multi-filament polyester weft yarns with a denier between 15 and 50, according to one embodiment.

The bedding is a woven textile fabric that includes from 90 to 235 ends per inch warp yarns and from 100 to 965 picks per inch multi-filament polyester weft yarns. The total thread count of the bedding material may be from 190 to 1200 and each multi-filament polyester yarn count of the bedding material may have from 10 to 30 filaments each, according to one embodiment.

An example embodiment will now be described. The ACME Textile Corp. may be engaged in production of consumer textiles. For sometime, the ACME Textile Corp. may have been facing dipping stock prices caused by significantly lowered sales of its product resulting in fall in profits. The reasons identified for low sales may be attributed to lowered demand due to lack of desirable qualities in its product, e.g., comfort for fabrics that come in contact with human skin, durability, and short useful lifespan of its textile.

To counter the downward trend, the ACME Textile Corp. may have decided to invest in using the textile manufacturing technology described herein (e.g., use of various embodiments of the FIGS. 1-9) for enhancing its textile fabric qualities. The use of various embodiments of the FIGS. 1-9 may have enabled the ACME Textile Corp. to enhance the desirable characteristics of its product. The use of cotton in forming its textile fabric enabled the ACME Textile Corp. to manufacture its product with high absorbency and breathability, thereby increasing comfort to its consumers while wearing.

Further, the use of various embodiments of the FIGS. 1-9 may have allowed the ACME Textile Corp. to produce textile fabric with cotton yarns woven in combination with synthetic fibers such as polyester, thereby increasing lifespan of the textile even when laundered in machine washers and dryers. In addition, the various embodiments of technologies of FIGS. 1-9 may have aided the ACME Textile Corp. to produce textile using relatively fine yarns thereby finer fabric with increased thread count per inch of fabric with a smaller denier increasing its quality of the textile, tactile satisfaction, and opulence of its consumers. As a result, the ACME Textile Corp. may now have increased profits due to rise in sales of its fabric.

In one or more embodiments, the woven textile fabric (e.g., textile 420) may be a "cross-weave" fabric, in which warp yarns (e.g., warp yarns 426) may be made of cotton and weft yarns (e.g., adjacent parallel yarns 101, parallel binary yarns 401) may be polyester filament yarns. In a sateen weave home textile implementation, typically involving 4 warps/1 weft or 5 warps/1 weft, almost 80-85% of cotton (e.g., warp yarns 426) may be on a top of the woven textile fabric or a front thereof while most of the polyester may be on a back of the woven textile fabric.

Figure 10:
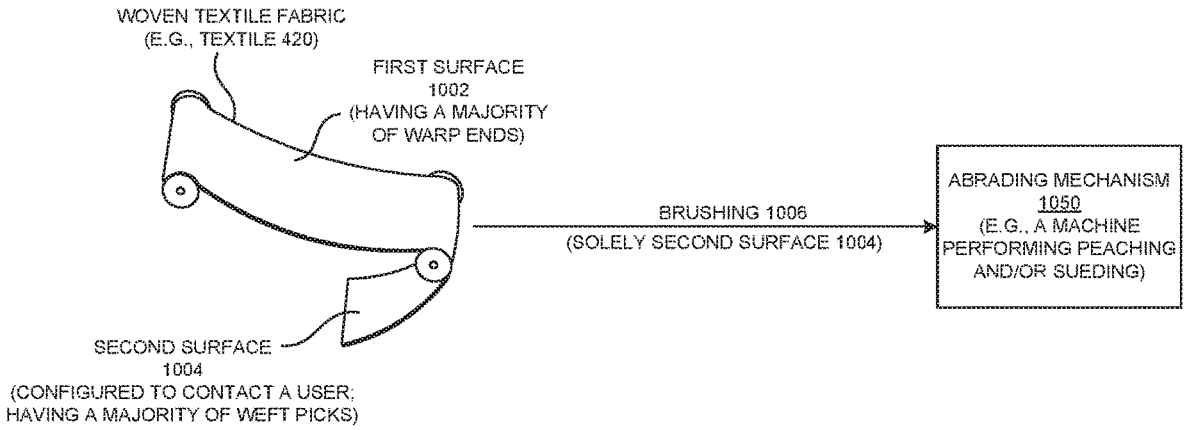
FIG. 10 is a schematic view of selective brushing of a surface of the woven textile fabric of FIG. 4, according to one or more embodiments.

Polyester, being a synthetic yarn, may provide for shininess and silkiness; this, in turn, may provide for a synthetic feel to a wearer of a piece of apparel made of the woven textile fabric discussed above. Thus, the bottom/backside of the woven textile fabric may have the shininess and the synthetic feel. FIG. 10 shows abrading (e.g., brushing) of the bottom/backside of the woven textile fabric (e.g., textile 420) through an abrading mechanism 1050 (e.g., a machine), according to one or more embodiments. FIG. 10 shows two surfaces of textile 420, viz. a first surface 1002 on which a majority of ends of warp yarns 426 may be found and a second surface 1004 on which a majority of picks of the multi-filament polyester weft yarn (e.g., adjacent parallel yarns 101, parallel binary yarns 401) may be found.

In accordance with one or more embodiments, second surface 1004 may be brushed (e.g., through brushing 1006) to remove the synthetic feel and shininess discussed above. In one or more embodiments brushing 1006 may be accomplished through peaching and/or sueding. Other forms of brushing 1006 are within the scope of the exemplary embodiments discussed herein. Peaching may be a post-processing operation performed on the woven textile fabric (e.g., textile 420), whereby the woven textile fabric is dried and brushed with rollers (e.g., abrasive rollers) during the drying thereof. The aforementioned process may break some fibers on second surface 1004 and/or render second surface "furry." Other types of peaching such as chemical peaching and sandpapering are within the scope of the exemplary embodiments discussed herein.

Sueding may be another process related to peaching, whereby second surface 1004 of the woven textile fabric is abraded through one or more roller(s) coated with abrasive paper. Sueding is within the scope of the exemplary embodiments discussed herein. Peaching and sueding (e.g., a combination of peaching and sueding may also be employed) are known to one skilled in the art. Detailed discussion associated therewith is, therefore, skipped for the sake of convenience and clarity. While brushing/abrading surfaces of a fabric is known to one skilled in the art, abrading of second surface 1004 alone is a novelty element of the exemplary embodiments discussed herein. In one or more embodiments, said selective abrading may render second surface 1004 contacting a user of the woven textile fabric smooth and furry and pleasant in "feel," thereby providing comfort to a user of the woven textile fabric (e.g., a piece of bedding, apparel) having contact with second surface 1004. In one or more embodiments, the aforementioned abrading runs counter to standard textile industry procedures that provide for abrading (and, therefore, furriness) on the surface not contacting the user; in other words, in typical implementations, the furriness is on the "outer" surface not contacting the user.

It is obvious that machines implementing the abovementioned sueding and/or peaching may be employed to abrade second surface 1004 through abrading mechanism 1050. All reasonable variations are within the scope of the exemplary embodiments discussed herein.

Although the present embodiments have been described with reference to specific example embodiments, it will be evident that various modifications and changes may be made to these embodiments without departing from the broader spirit and scope of the various embodiments. In addition, the process flows depicted in the figures do not require the particular order shown, or sequential order, to achieve desirable results. In addition, other operations may be provided, or operations may be eliminated, from the described flows, and other components may be added to, or removed from, the described systems. Accordingly, other embodiments are within the scope of the following claims.

What is claimed is:

1. A method of a woven textile fabric comprising:

drawing each of multiple partially oriented polyester yarns from a corresponding supply package to form an oriented polyester yarn therefrom as a single multi-filament polyester weft yarn;

inserting the multi-filament polyester weft yarn during a single pick insertion event of a pick insertion apparatus of a loom apparatus through winding the multi-filament polyester weft yarn on a single-pick yarn package, the pick insertion apparatus being at least one of an air jet pick insertion apparatus and a rapier pick insertion apparatus;

conveying, through the pick insertion apparatus, at least two of the multi-filament polyester weft yarn across a warp shed of the loom apparatus through a set of warp yarns in the single pick insertion event of the pick insertion apparatus to form an incremental length of the woven textile fabric having a first surface with a majority of ends of the warp yarns thereon and a second surface with a majority of picks of the multi-filament polyester weft yarn thereon; and solely abrading the second surface of the woven textile fabric to provide for comfort to a user of the woven textile fabric during contact of the user with the second surface of the woven textile fabric.

2. The method of claim 1, comprising solely abrading the second surface of the woven textile fabric through at least one of: peaching and sueding.

3. The method of claim 1, comprising the warp yarns being made of a cotton material.

4. The method of claim 1:

comprising the multi-filament polyester weft yarn having 10 to 30 filaments therein.

5. The method of claim 1, comprising:

the woven textile fabric having a minimum tensile strength in a warp direction of 17 kilograms to 65 kilograms, and the woven textile fabric having a minimum tensile strength in a weft direction of 11.5 kilograms to 100 kilograms.

6. The method of claim 1, comprising the woven textile fabric having a warp-to-fill ratio of 1:2 to 1:4.

7. The method of claim 1, comprising the multi-filament polyester weft yarn having a denier of one of: 15 to 35, 20 to 25 and 20 to 65.

8. A system comprising:

a textile fabric weaving apparatus comprising:

a multi-pick yarn package; and a loom apparatus comprising a pick insertion apparatus and a warp shed, wherein the loom apparatus receives a multi-filament polyester weft yarn inserted during a single pick insertion event of the pick insertion apparatus through the pick insertion apparatus winding the multi-filament polyester weft yarn on a single-pick yarn package, each of multiple partially oriented polyester yarns being drawn from a corresponding supply package to form an oriented polyester yarn therefrom as the multi-filament polyester weft yarn, and the pick insertion apparatus being at least one of an air jet pick insertion apparatus and a rapier pick insertion apparatus, and wherein the pick insertion apparatus conveys at least two of the multi-filament polyester weft yarn across the warp shed through a set of warp yarns in the single pick insertion event of the pick insertion apparatus to form an incremental length of the woven textile fabric having a first surface with a majority of ends of the warp yarns thereon and a second surface with a majority of picks of the multi-filament polyester weft yarn thereon; and an abrading mechanism solely abrading the second surface of the woven textile fabric to provide for comfort to a user of the woven textile fabric during contact of the user with the second surface of the woven textile fabric.

9. The system of claim 8, wherein the abrading mechanism solely abrades the second surface of the woven textile fabric through at least one of: peaching and sueding.

10. The system of claim 8, wherein the warp yarns are made of a cotton material.

11. The system of claim 8:

wherein the multi-filament polyester weft yarn has 10 to 30 filaments therein.

12. The system of claim 8, wherein:

the woven textile fabric has a minimum tensile strength in a warp direction of 17 kilograms to 65 kilograms, and the woven textile fabric has a minimum tensile strength in a weft direction of 11.5 kilograms to 100 kilograms.

13. The system of claim 8, wherein the woven textile fabric has a warp-to-fill ratio of 1:2 to 1:4.

14. The system of claim 8, wherein the multi-filament polyester weft yarn has a denier of one of: 15 to 35, 20 to 25 and 20 to 65.

15. A method of a woven textile fabric comprising:

drawing each of multiple partially oriented polyester yarns from a corresponding supply package to form an oriented polyester yarn therefrom as a single multi-filament polyester weft yarn;

inserting the multi-filament polyester weft yarn during a single pick insertion event of a pick insertion apparatus of a loom apparatus through winding the multi-filament polyester weft yarn on a single-pick yarn package, the pick insertion apparatus being at least one of an air jet pick insertion apparatus and a rapier pick insertion apparatus;

conveying, through the pick insertion apparatus, at least two of the multi-filament polyester weft yarn across a warp shed of the loom apparatus through a set of cotton warp yarns in the single pick insertion event of the pick insertion apparatus to form an incremental length of the woven textile fabric having a first surface with a majority of ends of the cotton warp yarns thereon and a second surface with a majority of picks of the multi-filament polyester weft yarn thereon; and solely abrading the second surface of the woven textile fabric to provide for comfort to a user of the woven textile fabric during contact of the user with the second surface of the woven textile fabric.

16. The method of claim 15, comprising solely abrading the second surface of the woven textile fabric through at least one of: peaching and sueding.

17. The method of claim 15:

comprising the multi-filament polyester weft yarn having 10 to 30 filaments therein.

18. The method of claim 15, comprising:

the woven textile fabric having a minimum tensile strength in a warp direction of 17 kilograms to 65 kilograms, and the woven textile fabric having a minimum tensile strength in a weft direction of 11.5 kilograms to 100 kilograms.

19. The method of claim 15, comprising the woven textile fabric having a warp-to-fill ratio of 1:2 to 1:4.

20. The method of claim 15, comprising the multi-filament polyester weft yarn having a denier of one of: 15 to 35, 20 to 25 and 20 to 65.

* * * * *